US008107847B2

(12) United States Patent
Kawai et al.

(10) Patent No.: US 8,107,847 B2
(45) Date of Patent: Jan. 31, 2012

(54) IMAGE EXPOSURE APPARATUS, CLEANING DEVICE OF IMAGE EXPOSURE APPARATUS, AND IMAGE FORMING APPARATUS

(75) Inventors: Jun Kawai, Saitama (JP); Shinichi Ohba, Saitama (JP); Kenji Hayashi, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 617 days.

(21) Appl. No.: 12/252,948

(22) Filed: Oct. 16, 2008

(65) Prior Publication Data

US 2009/0245850 A1 Oct. 1, 2009

(30) Foreign Application Priority Data

Mar. 27, 2008 (JP) ..... P2008-082663
Mar. 27, 2008 (JP) ..... P2008-082700

(51) Int. Cl.
*G03G 15/00* (2006.01)
*G03G 21/00* (2006.01)

(52) U.S. Cl. ..... 399/98; 399/118; 399/411

(58) Field of Classification Search ..... 399/98–100, 399/118, 207, 411
See application file for complete search history.

(56) References Cited

U.S. PATENT DOCUMENTS

2004/0240905 A1* 12/2004 Yamazaki ..... 399/98
2008/0025747 A1* 1/2008 Lim ..... 399/71

FOREIGN PATENT DOCUMENTS

| | | |
|---|---|---|
| JP | 9-160470 | 6/1997 |
| JP | 11-295950 | 10/1999 |
| JP | 2001-265096 | 9/2001 |
| JP | 2001-343876 | 12/2001 |
| JP | 2002-267983 | 9/2002 |
| JP | 2004-085899 | 3/2004 |
| JP | 2005-329622 A | 12/2005 |
| JP | 2006-027168 | 2/2006 |
| JP | 2006-267137 | 10/2006 |
| JP | 2007-086605 | 4/2007 |

* cited by examiner

*Primary Examiner* — David Gray
*Assistant Examiner* — Joseph Wong
(74) *Attorney, Agent, or Firm* — Morgan, Lewis & Bockius LLP

(57) ABSTRACT

An image exposure apparatus is provided and includes: an optical unit that emits light to form an exposure image on a photosensitive material; a casing that houses the optical unit and that has an image exposure window through which the light is allowed to pass for forming the exposure image; a transparent dustproof member at the image exposure window; and a shutter member switched between a shield position for covering a region above the dustproof member, which serves as a passage region of a cleaning member for cleaning a surface of the dustproof member, and an open position for allowing the light to pass through the dustproof member to form an exposure image on a surface of the photosensitive material. When the shutter member is located at the shield position, at least a part of the shutter member goes into the passage region of the cleaning member.

15 Claims, 28 Drawing Sheets

(a)

(b)

IMAGE EXPOSURE APPARATUS, CLEANING DEVICE OF IMAGE EXPOSURE APPARATUS, AND IMAGE FORMING APPARATUS

CROSS-REFERENCE TO RELATED APPLICATION

This application is based on and claims priority under 35 USC §119 from Japanese Patent Application Nos. 2008-82663 and 2008-82700, both filed Mar. 27, 2008.

BACKGROUND (i) Technical Field

The present invention relates to an image exposure apparatus, an cleaning device of an image exposure apparatus, and an image forming apparatus using those.

(ii) Related Art

Conventional image forming apparatuses include one formed so that an intermediate transfer belt is provided at upper parts of image forming sections of respective colors of yellow (Y), magenta (M), cyan (C) and black (K), and an exposure image is formed on a photosensitive drum of each image forming section by an image exposure apparatus provided below each image forming section.

Since an exposure image is formed on the photosensitive drum from below the photosensitive drum in the image exposure apparatus used for such an image forming apparatus, a toner might fall from the photosensitive drum and/or a developing device, and an optical component such as a mirror of the image exposure apparatus might be soiled. Therefore, the image exposure apparatus is formed so that, at an opening section thereof through which the photosensitive drum is scanned with and exposed to a laser beam, there is provided an exposure window consisting of a transparent member such as glass, and there is provided a cleaning member for cleaning the exposure window at predetermined timing. Further, in order to prevent a toner or the like from falling onto the exposure window and adhering thereto at a non-image exposure time during which the photosensitive drum is not scanned with and exposed to a laser beam, the image exposure apparatus is provided with a shutter member for covering a surface of the exposure window in an openable and closable manner.

SUMMARY

According to an aspect of the invention, there is provided an image exposure apparatus comprising:

an optical unit that emits light to form an exposure image on a photosensitive material;

a casing that houses the optical unit and that has an image exposure window through which the light is allowed to pass for forming the exposure image;

a transparent dustproof member at the image exposure window; and a shutter member switched between a shield position for covering a region above the dustproof member, which serves as a passage region of a cleaning member for cleaning a surface of the dustproof member, and an open position for allowing the light to pass through the dustproof member to form an exposure image on a surface of the photosensitive material, wherein when the shutter member is located at the shield position, at least a part of the shutter member goes into the passage region of the cleaning member.

BRIEF DESCRIPTION OF THE DRAWINGS

Embodiments of the present invention will be described in detail based on the following figures, wherein.

DETAILED DESCRIPTION

Hereinafter, exemplary embodiments of the present invention will be described with reference to the drawings.

Embodiment 1

Figure 2:
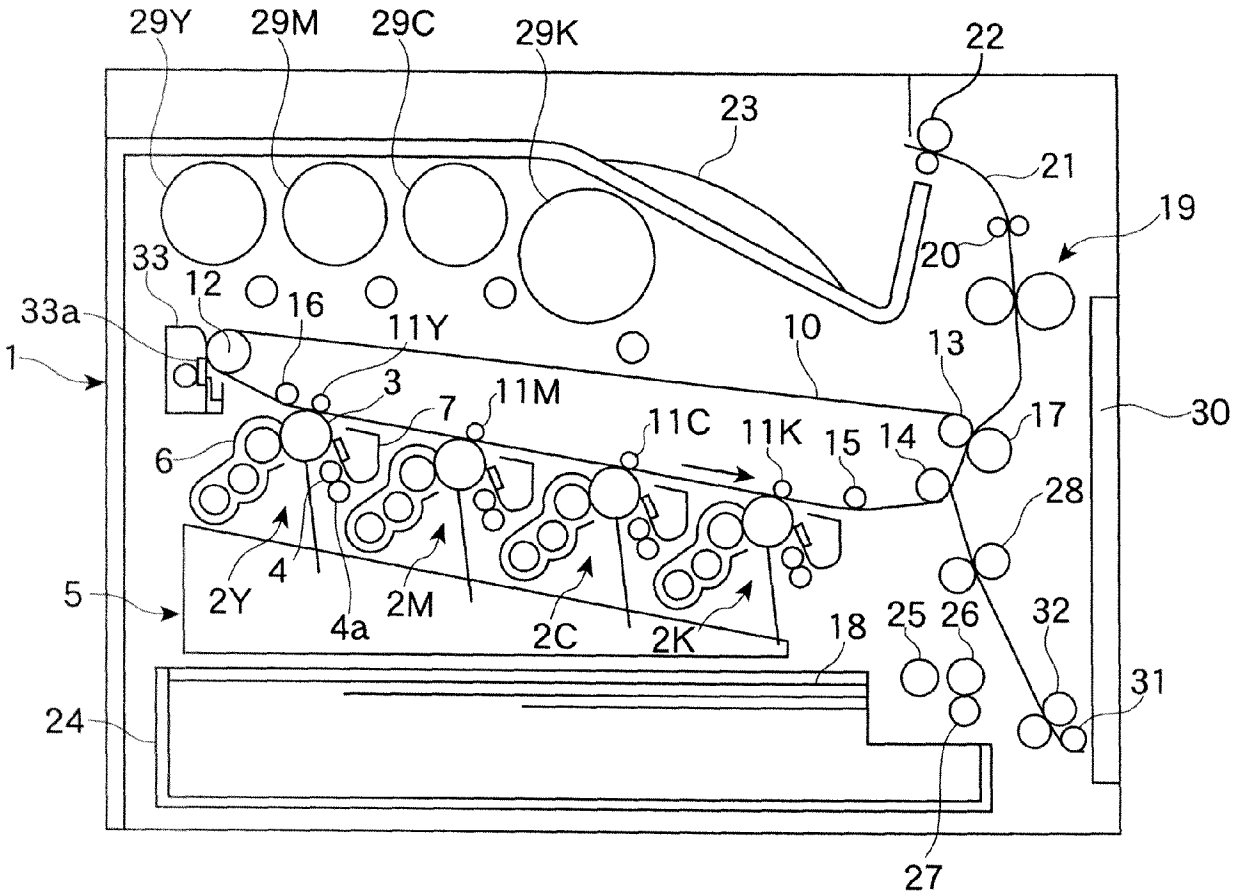
FIG. 2 is a schematic diagram showing a tandem-type full-color printer serving as an image forming apparatus according to exemplary Embodiment 1 of the present invention.

FIG. 2 shows a tandem-type digital full-color printer serving as an image forming apparatus to which an image exposure apparatus and a cleaning device according to exemplary Embodiment 1 of the present invention are applied.

In FIG. 2, the reference numeral 1 represents a main body of the tandem-type digital full-color printer, and this printer main body 1 is provided, at its inside, with an image processing device (not shown) for performing predetermined image processing on image data sent from, for example, a scanner, a personal computer, and/or a telephone line, which are/is not shown.

As shown in FIG. 2, inside the tandem-type digital full-color printer main body 1, four image forming units (image forming sections) 2Y, 2M, 2C and 2K of yellow (Y), magenta (M), cyan (C) and black (K) are parallelly disposed at regular spacings so to be inclined diagonally at a predetermined angle (e.g., at 10 degrees) with respect to a horizontal direction such that the image forming unit 2Y of the first color yellow (Y) is located at a relatively high position, while the image forming unit 2K of the final color black (K) is located at a relatively low position.

The four image forming units 2Y, 2M, 2C and 2K of yellow (Y), magenta (M), cyan (C) and black (K) are disposed so as to be inclined diagonally at a predetermined angle in this manner, thereby making it possible to set the widthwise distance to a shorter distance as compared with a case where these four image forming units 2Y, 2M, 2C and 2K are horizontally disposed, and to reduce the width of the printer main body 1, resulting in size reduction.

Figure 3:
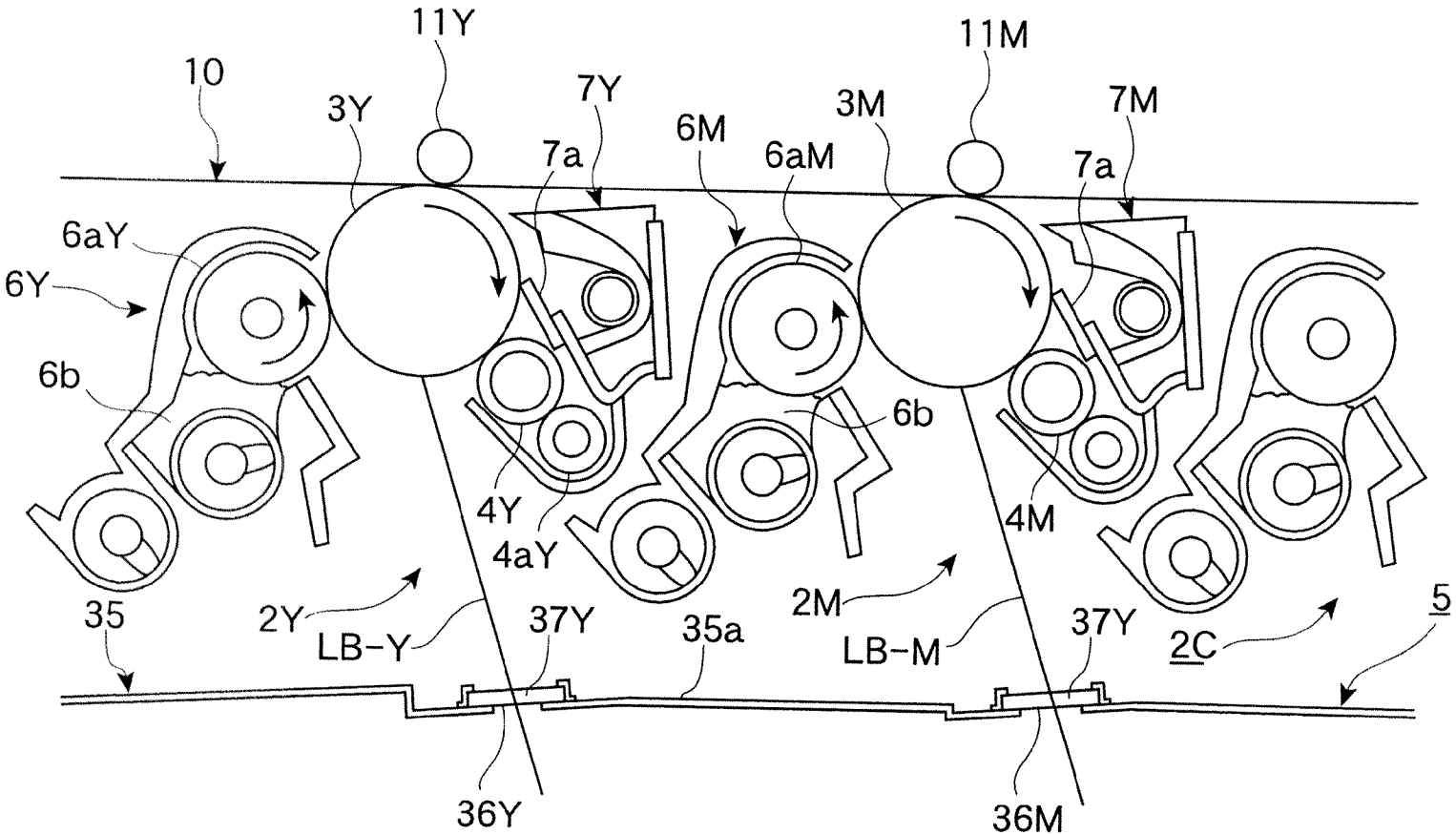
FIG. 3 is a schematic diagram showing image forming sections of a tandem-type full-color printer serving as an image forming apparatus according to exemplary Embodiment 1 of the present invention.

These four image forming units 2Y, 2M, 2C and 2K are basically formed in the similar manner. Broadly, as shown in FIGS. 2 and 3, the image forming units each include: a photosensitive drum 3 (3Y, 3M, 3C, 3K, serving as an image carrier rotatably driven at a predetermined speed by an unshown driving means; a charging roller 4 (4Y, 4M, 4C, 4K) for primary charging, which uniformly charges a surname of the photosensitive drum 3; a developing instrument 6 (6Y, 6M. 6C, 6K) for developing, with a predetermined color toner, an electrostatic latent image formed on the photosensitive drum 3 by image exposure of an after-mentioned image exposure apparatus 5; and a cleaning device 7 for cleaning the surface of the photosensitive drum 3.

As the photosensitive drum 3, there is used, for example, a member consisting of an organic photosensitive material formed into a drum shape with a diameter of 30 mm and having an overcoat layer at its surface, and the photosensitive drum 3 is rotatably driven at a predetermined rotational speed by an unshown drive motor.

Further, as the charging roller 4, there is used, for example, a roller-shaped charging instrument coated, at a surface of its cored bar, with a conductive layer which is made of synthetic resin and/or rubber and in which electric resistance is adjusted, and as the cored bar of this charging roller 4, there is used a member to which a predetermined charging bias is applied. Furthermore, at the surface of this charging roller 4, a cleaning roller 4*a* (4*a*Y, 4*a*M, 4*a*C, 4*a*K, for removing a foreign substance such as a toner adhered to the surface of the charging roller 4 is disposed so as to be brought into contact therewith.

As shown in FIG. 2, the image exposure apparatus 5 common to the four image forming units 2Y, 2M, 2C and 2K is provided at lower parts of these image forming units 2Y, 2M, 2C and 2K. As shown in FIG. 3, this image exposure apparatus 5 includes four unshown semiconductor lasers each emitting a laser beam modulated in accordance with image data; thus, deflection scanning of four laser beams (LB-Y, LB-M, LB-C, LB-K) emitted from these semiconductor lasers is performed by a polygon mirror 8, and the photosensitive drum 3 of each of the image forming units 2Y, 2M, 2C and 2K is scanned with and exposed to the laser beam via a lens and/or a mirror, which are/is unshown.

In this embodiment, the image exposure apparatus 5 is provided across the lower parts of the four image forming units 2Y, 2M, 2C and 2K, and these four image forming units 2Y, 2M, 2C and 2K are provided so as to be inclined with respect to the horizontal direction. Therefore, the image exposure apparatus 5 is provided in a space formed at the lower parts of the respective image forming units 2Y, 2M, 2C and 2K and having an approximately triangular shape in front view, so that optical path lengths of the respective laser beams, with which and to which the photosensitive drums 3 of the respective image forming units 2Y, 2M, 2C and 2K are scanned and exposed, become equal.

From the image processing device, image data of respective colors is sequentially outputted to the image exposure apparatus 5 provided as the common apparatus to the image forming units 2Y, 2M, 2C and 2K of respective colors of yellow (Y), magenta (M), cyan (C) and black (K) and the surfaces of the associated photosensitive drums 3 are scanned with and exposed to laser beams LB-Y, LB-M, LB-C and LB-K emitted from the image exposure apparatus 5 in accordance with he image data, thereby forming electrostatic latent images. The electrostatic latent images formed on the photosensitive drums 3 are developed as toner images of respective colors of yellow (Y), magenta (M), cyan (C) and black (K) by developing instruments 6Y, 6M, 6C and 6K.

The toner images of respective colors of yellow (Y), magenta (M), cyan (C) and black (K), sequentially formed on the photosensitive drums 3 of the respective image forming units 2Y, 2M, 2C and 2K, are multi-transferred, by primary transfer rollers 11 (11Y, 11M, 11C, 11K), onto an intermediate transfer belt 10 serving as a belt-shaped intermediate transfer element disposed so as to be inclined above the respective image forming units 2Y, 2M, 2C and 2K.

This intermediate transfer belt 10 is a belt-shaped member spanned by a plurality of rollers, and is disposed so to be inclined with respect to the horizontal direction such that the downstream lower running region of the belt-shaped member along its running direct ion s located at a lower position and the upstream lower running region thereof is located at a higher position.

Specifically, as shown in FIG. 2, the intermediate transfer belt 10 is placed at a constant tension across a drive roller 13, a backup roller 12, a tension roller 14, a first idler roller 15 and a second idler roller 16, and is driven in a circulating manner at a predetermined speed in the direction indicated by the arrow via the drive roller 13 rotatably driven by an unshown dedicated drive motor having an excellent constant speed property. As the intermediate transfer belt 10, for example, there is used a member that is formed into an endless belt by forming a film of synthetic resin such as flexible polyimide into a strip and connecting both ends of this strip-shaped synthetic resin film by means of welding or the like. The intermediate transfer belt 10 is disposed, in its lower running region, so as to be brought into contact with the photosensitive drums 3Y, 3M, 3C and 3K of the respective image forming units 2Y, 2M, 2C and 2K.

Figure 4:
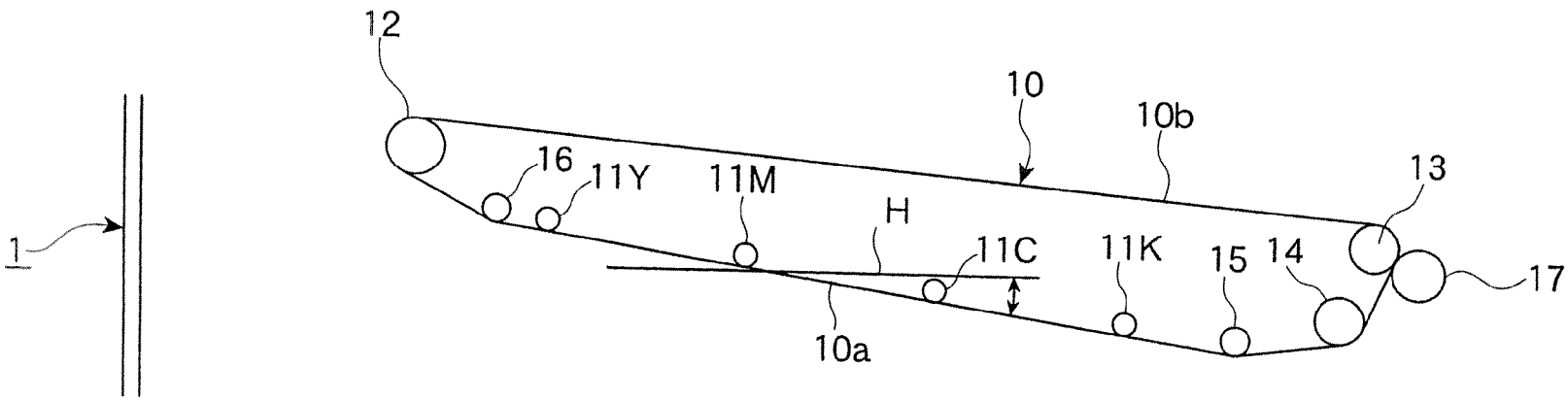
FIG. 4 is a schematic diagram showing how an intermediate transfer belt is disposed.

Furthermore, as shown in FIG. 4, the intermediate transfer belt 10 is disposed so that its lower running region 10*a* is inclined by an angle θ (e.g., 10 degrees) with respect to a horizontal direction H, and is disposed such that a secondary transfer roller 17 serving as a secondary transfer means for secondarily transferring a toner image, which has been primarily transferred onto the intermediate transfer belt 10, onto a recording medium, abuts against the surface of the intermediate transfer belt 10 spanned by the drive roller 13.

As shown in FIG. 2, the toner images of respective colors of yellow Y magenta (M), cyan (C) and black (K) multi-transferred onto the intermediate transfer belt 10 are secondarily transferred, by the secondary transfer roller 17 pressed against the drive roller 13, onto a recording sheet 18 serving as a recording medium with the use of a pressing force and an electrostatic force, and the recording sheet 18 on which the toner images of the respective colors have been transferred is conveyed to a fuser 19 located at a higher position. The secondary transfer roller 17 is formed so as to be pressed laterally against the drive roller 13, and to secondarily transfer the toner images of the respective colors on the recording sheet 18 to be conveyed upward from below in the vertical direction.

Further, the recording sheet 18 on which the toner images of the respective colors have been transferred is subjected to a fusing process by the fuser 19 utilizing heat and pressure, and is then discharged onto a discharge tray 23 provided at an upper part of the printer main body 1 by a discharge roller 22 via an outlet roller 20 of the fuser 19 and a sheet discharge path 21.

As shown in FIG. 2, from a feed tray 24 disposed inside the printer main body 1, he recording sheets 18, each having a predetermined size and made of a predetermined material, are temporarily conveyed to and stopped at a resist roller 28 with the recording sheets 18 separated one by one by a feed roller 25 and a pair of sheet separation and conveyance roller 26, 27. The recording sheet 18 fed from the feed tray 24 is sent to a secondary transfer position of the intermediate transfer belt 10 by the resist roller 28 rotatably driven at predetermined timing.

In FIG. 2, the reference numerals 29Y, 29M, 29C and 29K represent toner cartridges for supplying toners of predetermined colors to the developing instruments 6Y, 6M, 6C and 6K of respective colors of yellow (Y), magenta (M), cyan (C) and black (K), respectively, and the toner cartridge containing a black (K) toner is formed to have a larger size as compared with the toner cartridges of the other colors since the black toner cartridge is frequently used.

Furthermore, in FIG. 2, the reference numeral 30 represents a manual tray provided at a lateral face of the printer main body 1, and from this manual tray 30, the recording sheets 18, each made of a desired material and having a predetermined size, are conveyed to the resist roller 28 via a feed roller 31 and a sheet separation and conveyance roller 32.

FIG. 3 shows the respective image forming units of the above-described digital full-color printer.

As shown in FIG. 3, the four image forming units 2Y, 2M, 2C and 2K of yellow, magenta, cyan and black colors mentioned above are all formed in the similar manner, and these four image forming units 2Y, 2M, 2C and 2K are formed so that the toner images of yellow, magenta, cyan and black colors are sequentially formed at predetermined timing as described above. As already described above, the image forming units 2Y, 2M, 2C and 2K of the respective colors include the photosensitive drums 3, and the surfaces of these photosensitive drums 3 are uniformly charged by the charging rollers 4 for primary charging. Thereafter, the surfaces of the photosensitive drums 3 are scanned with and exposed to the laser beams LB-Y, LB-M, LB-C and LB-K emitted from the image exposure apparatus 5 in accordance with image data, thereby forming electrostatic latent images associated with the respective colors. The laser beams LB-Y, LB-M, LB-C and LB-K, with which and to which the photosensitive drums 3 are scanned and exposed, are set so that the photosensitive drums 3 are exposed to the laser beams LB-Y, LB-M, LB-C and LB-K at predetermined inclination angles from positions located diagonally below the photosensitive drums 3 and slightly rightward with respect to positions immediately below the photosensitive drums 3. The electrostatic latent images formed on the photosensitive drums 3 are developed into visible toner images by developing rollers 6*a* (6*a*Y, 6*a*M, 6*a*C, 6*a*K, of the developing instruments 6 of the respective image forming units 2Y, 2M, 2C and 2K with the use of the toners of yellow, magenta, cyan and black colors, and these visible toner images are sequentially multi-transferred onto the intermediate transfer belt 10 by the charging of the primary transfer rollers 11.

The respective developing instruments 6Y, 6M, 6C and 6K employ a two-component development system that uses a two-component developer 6*b* including a toner and a carrier, and are formed so as to provide, on the surface of each developing roller 6*a*, a magnetic brush for the two-component developer 6*b* including a toner and a carrier, and to develop electrostatic latent images formed on the surfaces of the photosensitive drums 3Y, 3M, 3C and 3K of the associated colors.

It should be noted that, from the surfaces of the photosensitive drums 3 after the toner image transfer process has been finished, residual toners, paper dusts or the like are removed by the cleaning devices 7 (7Y, 7M, 7C, 7K), thus preparing for the subsequent image forming process. The cleaning devices 7 each include a cleaning blade 7*a* (7*a*Y, 7*a*M, 7*a*C, 7*a*K), and remove waste toners on the photosensitive drum 3 using this cleaning blade 7*a*.

Moreover, as shown in FIG. 2, from the surface of the intermediate transfer belt 10 after the toner image transfer process has been finished, residual 4*a* toners, paper dusts or the like are removed by a cleaning device 33 following the secondary transfer, thus preparing for the subsequent image forming process. As shown in FIG. 2, the cleaning device 33 includes a cleaning blade 33*a*, and removes waste toners, paper dusts or the like on the intermediate transfer belt 10 using this cleaning blade 33*a*.

Figure 5:
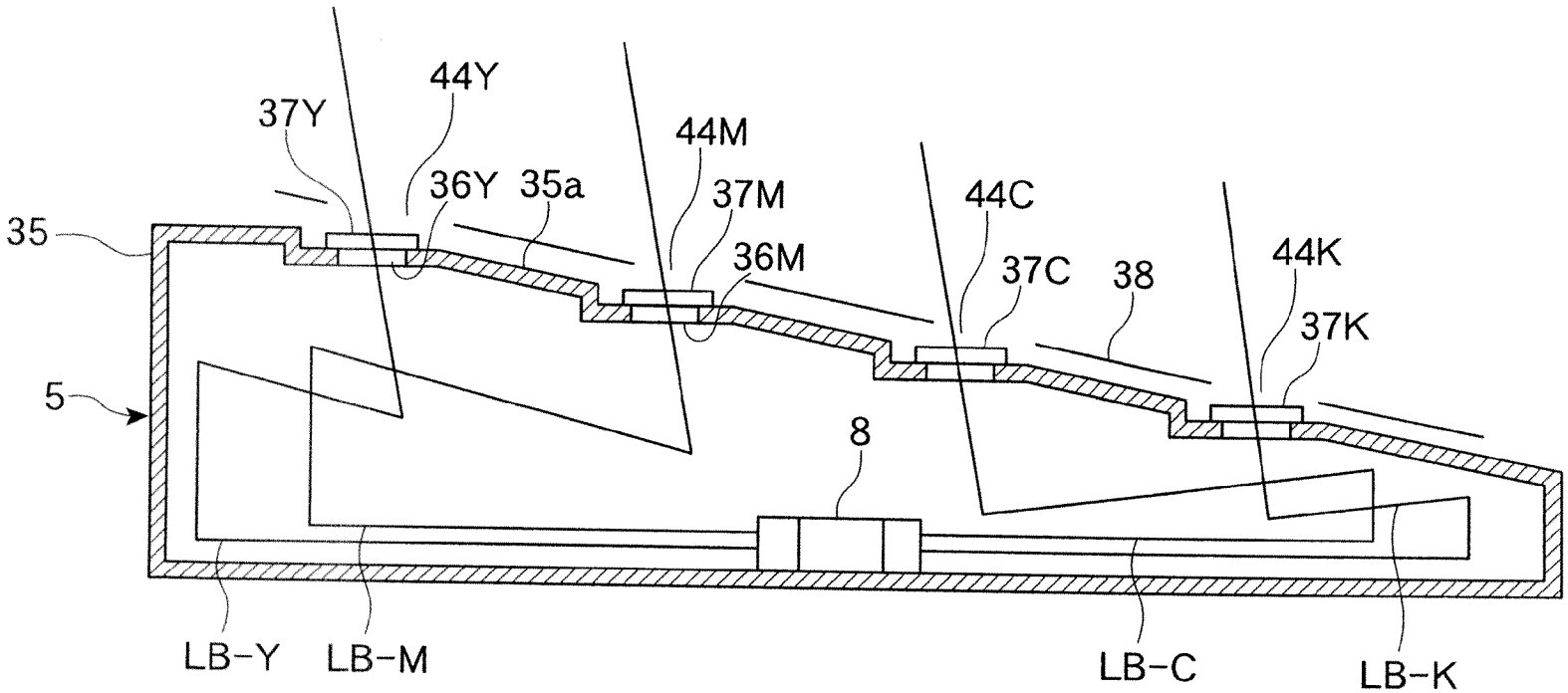
FIG. 5 is a schematic diagram showing an image exposure apparatus according to exemplary Embodiment 1 of the present invention.

In addition, as shown in FIG. 5, the image exposure apparatus 5 according to this embodiment includes: four unshown semiconductor lasers for emitting the laser beams LB-Y, LB-M, LB-C and LB-K based on image data associated with the respective yellow, magenta, cyan and black colors; and/or an optical component such as the polygon mirror 8, or an unshown lens and/or an unshown mirror. If a foreign substance such as a toner is adhered to such an optical component, the laser beams LB-Y, LB-M, LB-C and LB-K are cut off and/or scattered, which results in degradation in the quality of an image exposed on the photosensitive drum 3.

Therefore, the image exposure apparatus 5 is enclosed, at its periphery, with a box-like casing 35 in order to prevent a foreign substance such as a toner from intruding into the image exposure apparatus 5. Further, the casing 35 is provided, at its upper end face 35*a*, with exposure windows 36 (e.g., 36Y, 36M) through which the photosensitive drums 3 of the yellow, magenta, cyan and black color image forming units 2Y, 2M, 2C and 2K are scanned with and exposed to the laser beams LB-Y, LB-M, B-C and LB-K, and these exposure windows 36 are provided with dustproof members 37Y, 37M, 37C and 37K, each consisting of a transparent glass plate or the like, for preventing the intrusion of a foreign substance such as a toner. These dustproof members 37Y, 37M, 37C and 37K are horizontally disposed, and located so that the heights of the respective dustproof members 37Y, 37M, 37C and 37K gradually differ in accordance with the inclinations of the respective photosensitive drums 3Y, 3M, 3C and 3K.

Figure 6:
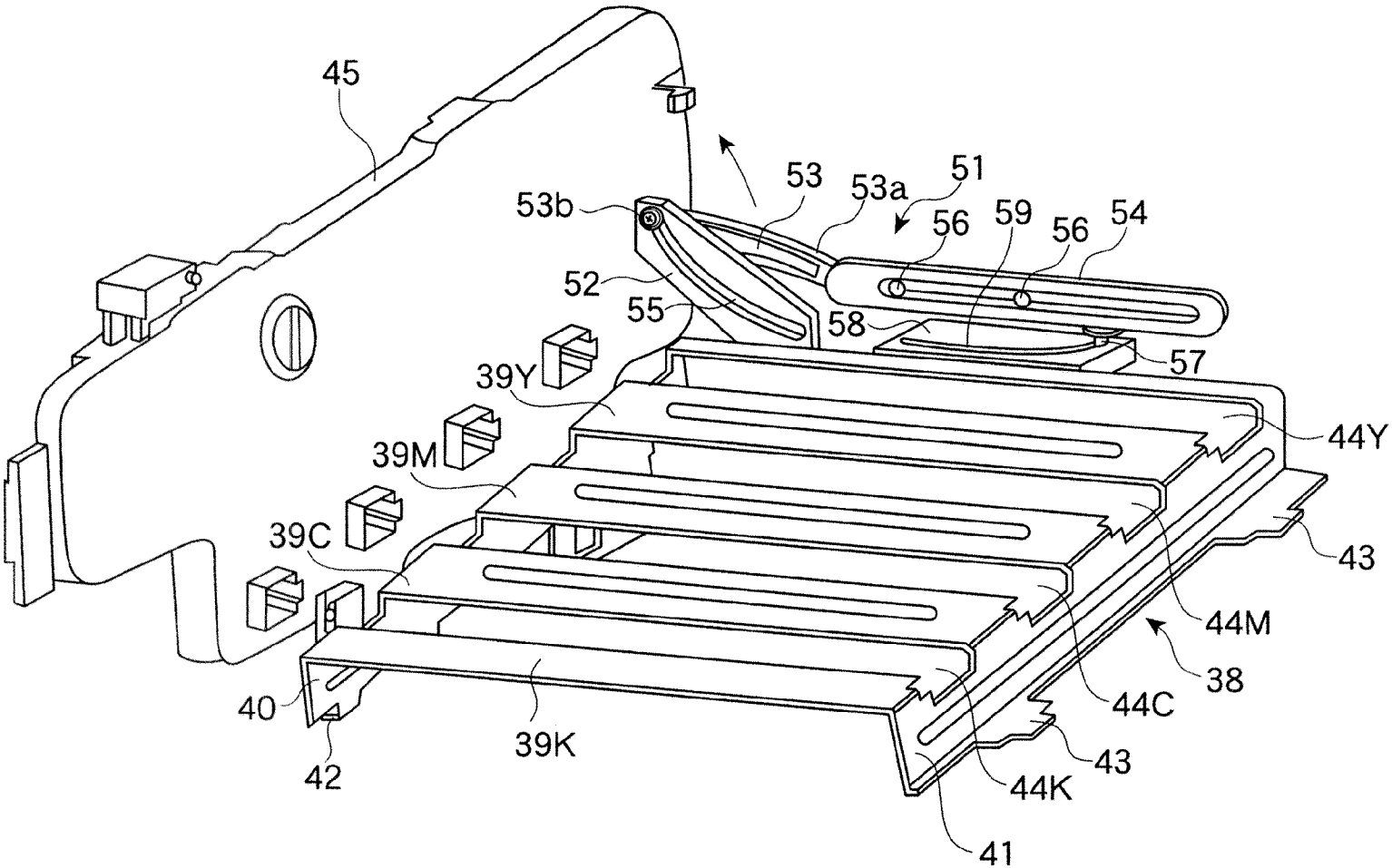
FIG. 6 is a perspective schematic view showing a shutter member.

Furthermore, as shown in FIG. 5, at the surface of the image exposure apparatus 5, a shutter member 38 for opening/closing the four dustproof members 37Y, 37M, 37C and 37K is slidably provided. As shown in FIG. 6, this shutter member 38 is formed by a sheet metal made of a metal such as a stainless steel and/or aluminum, and includes: shutter sections 39 (39Y, 39M, 39C, 39K) disposed parallelly at an upper face of the image exposure apparatus 5; erected plate sections 40 and 41 provided continuously at both ends of the shutter sections 39 so as to be bent downward; and slide sections 42 and 43 provided at lower ends of the erected plate sections 40 and 41 so as to be protruded outward.

As shown in FIG. 6, between the shutter sections 39 of the shutter member 38, cutout sections 44Y, 44M, 44C and 44K for exposure are provided at positions associated with the dustproof members 37Y, 37M, 37C and 37K. And as shown in FIG. 5, the image exposure apparatus 5 is formed so that the cutout sections 44Y, 44M, 44C and 44K are moved to upper parts of the dustproof members 37Y, 37M, 37C and 37K, thus carrying out image exposure.

Besides, as shown in FIG. 6, the shutter member 38 is formed so that, in response to the opening/closing operation of an inner cover 45 provided in an openable and closable manner at a front face inside the printer main body 1, the shutter member 38 is moved to a shield position at which the dustproof members 37Y, 37M, 37C and 37K are shielded, and to an open position at which the dustproof members 37Y, 37M, 37C and 37K are opened.

Figure 7:
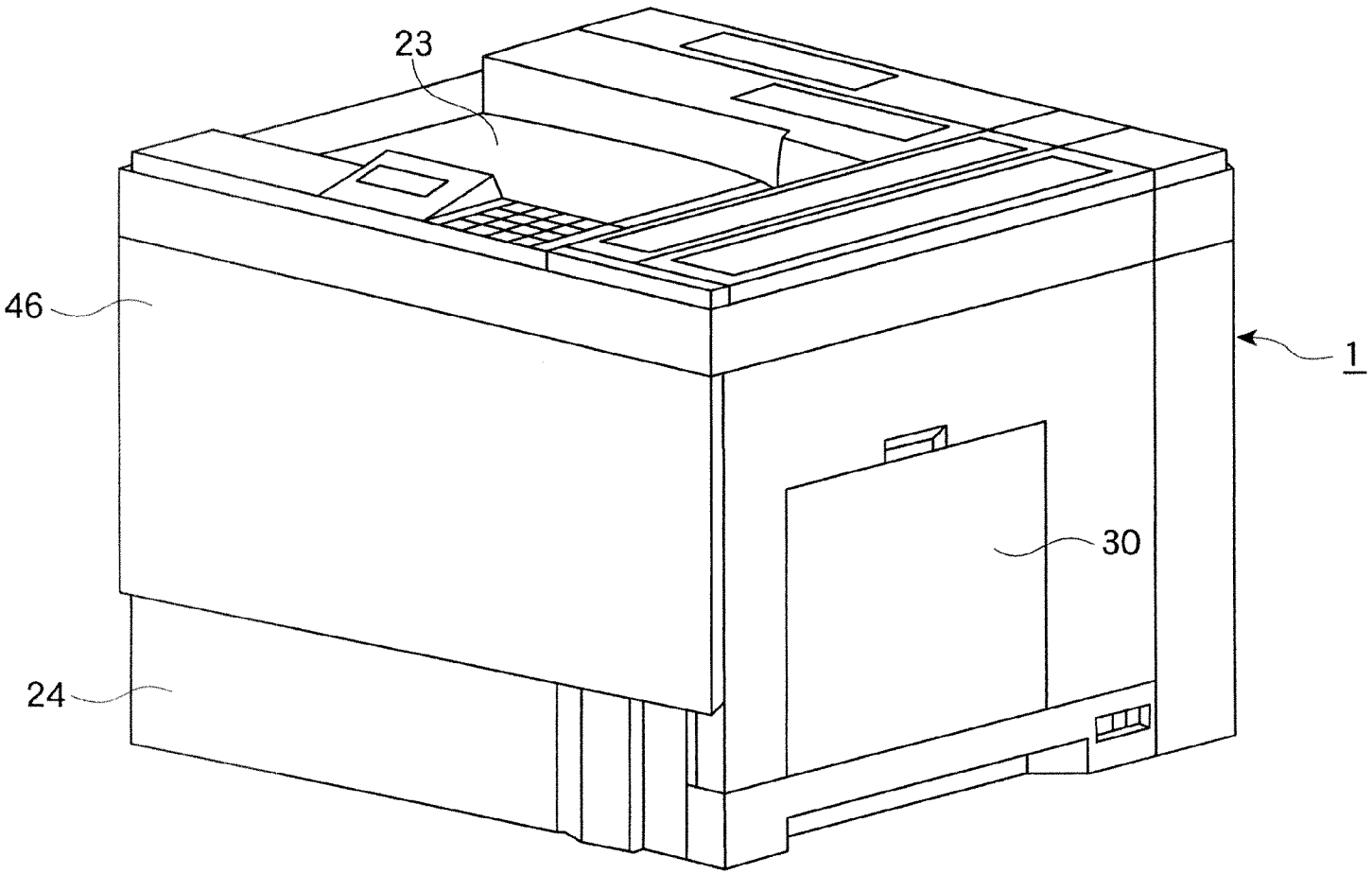
FIG. 7 is an external perspective view showing a tandem-type full-color printer serving as an image forming apparatus according to exemplary Embodiment 1 of the present invention.
Figure 8:
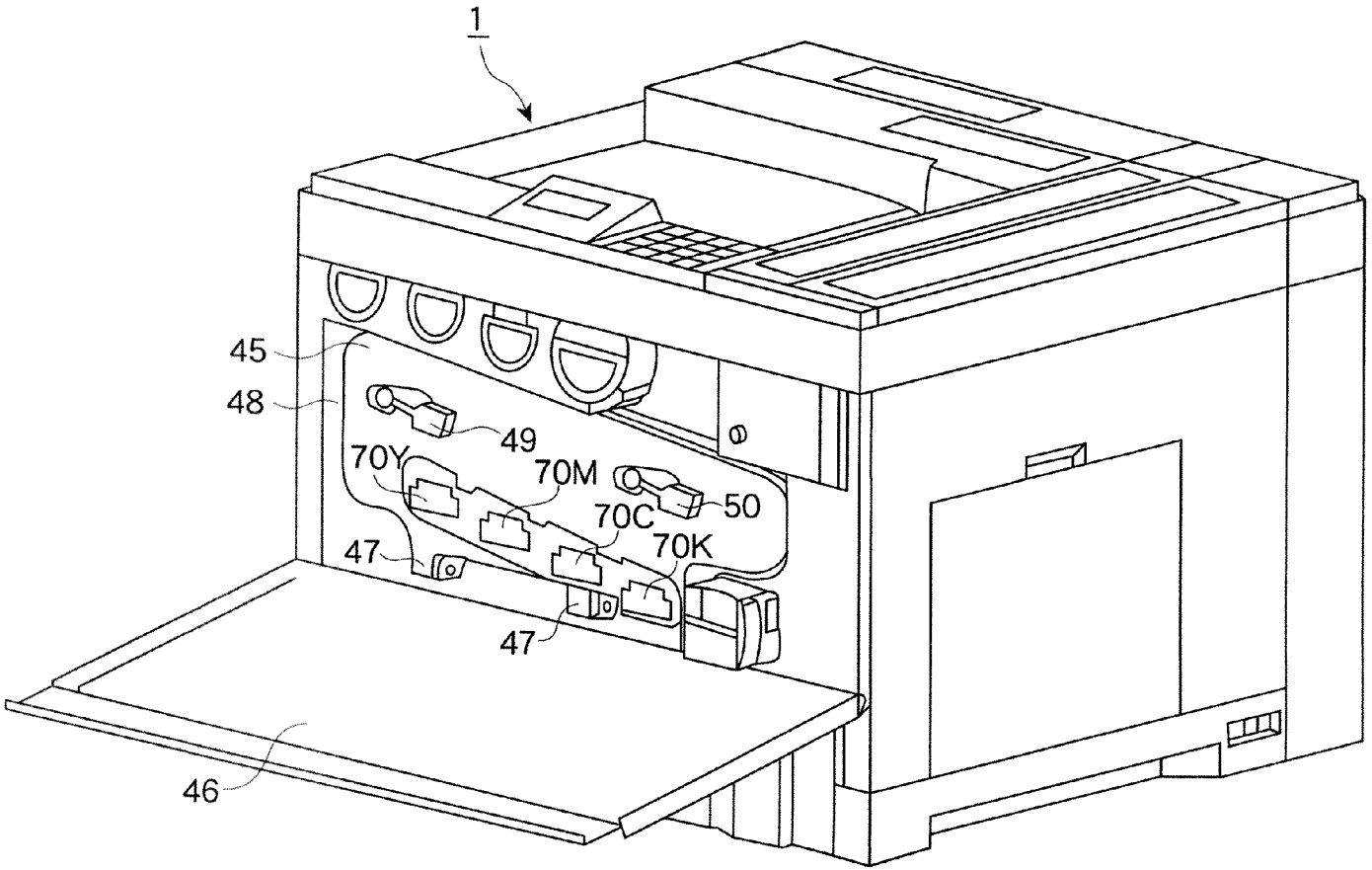
FIG. 8 is an external perspective view showing a state in which a front cover of a tandem-type full-color printer serving as an image forming apparatus according to exemplary Embodiment 1 of the present invention is opened.

More specifically, as shown in FIG. 7, the printer main body 1 is provided, at its front face, with a front cover 46 that is opened/closed when maintenance is performed such that the front cover 46 is openable and closable toward the front via an unshown hinge section provided at a lower end of the front cover 46. And as shown in FIG. 8, inside the front cover 46, the inner cover 45 serving as a fixing member for covering front faces of the image forming units 2Y, 2M, 2C and 2K is attached so as to be openable and closable toward the front with respect to the printer main body 1 via a hinge section 47 provided at a lower end of the inner cover 45. This inner cover 45 has the function of fixing the front face side positions of the image forming units 2Y, 2M, 2C and 2K, is opened/closed when the image forming units 2Y, 2M, 2C and 2K are replaced, for example, and constitutes a second frame at the front face side of a frame 48 inside the printer main body 1. Furthermore, in order to prevent a user from erroneously opening/closing the inner cover 45 when a paper jam or the like has occurred, the inner cover 45 is provided at its right and left upper parts with operation levers 49 and 50 for allowing the inner cover 45 to be openable only after the operation levers 49 and 50 are rotated to open positions.

Figure 9:
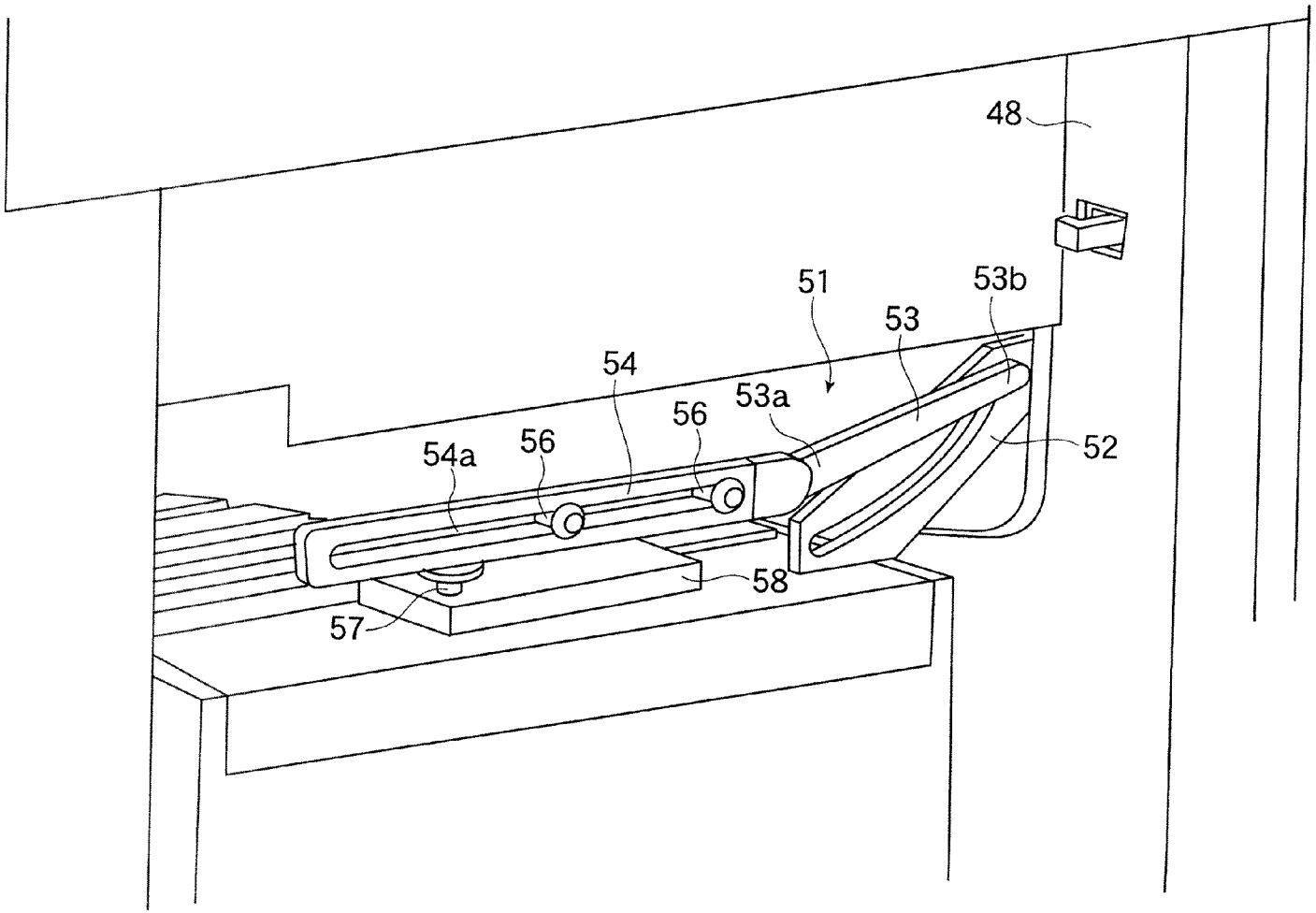
FIG. 9 is a perspective schematic view showing a link mechanism.

In addition, as shown in FIGS. 6 and 9, the inner cover 45 is provided, at one end (in the shown example, a left end) of its inner face, with a link mechanism 51 for moving the shutter member 38. This link mechanism 51 includes: a first link 52 attached so as to be fixed to the inner face of the inner cover 45; a third link 54 horizontally slidably attached to the printer main body 1; and a second link 53 through which these first link 52 and third link 54 are connected to each other. The first link 52 is fixedly attached to the inner face of the inner cover 45 so as to be protruded toward the inside of the printer main body 1, and the first link 52 is provided with a curved groove section 55 for guiding a front end 53*b* of the second link 53. Further, a base end 53*a* of the second link 53 is rotatably supported at a front end of the third link 54, and the front end 53*b* of the second link 53 is slidably fitted into the groove section 55 of the first link 52. Furthermore, the third link 54 is slidably attached along the horizontal direction via: a slide groove 54*a* provided along the longitudinal direction of the third link 54, and two slide pins 56 provided inside the printer main body 1 so as to be protruded at a predetermined spacing along the horizontal direction. A cylindrical cam follower member 57 is attached to a lower end of the third link 54 at its intermediate position, and the cam follower member 57 is engaged with a flat plate cam member 58 attached to an upper end of the shutter member 38.

The cam follower member 57 provided at the third link 54 and the cam member 58 attached to the shutter member 38 serve to convert a sliding operation of the third link 54 along the horizontal direction, associated with the opening/closing operation of the inner cover 45, into a sliding operation of the shutter member 38 along an upper face of the image exposure apparatus 5.

Figure 10:
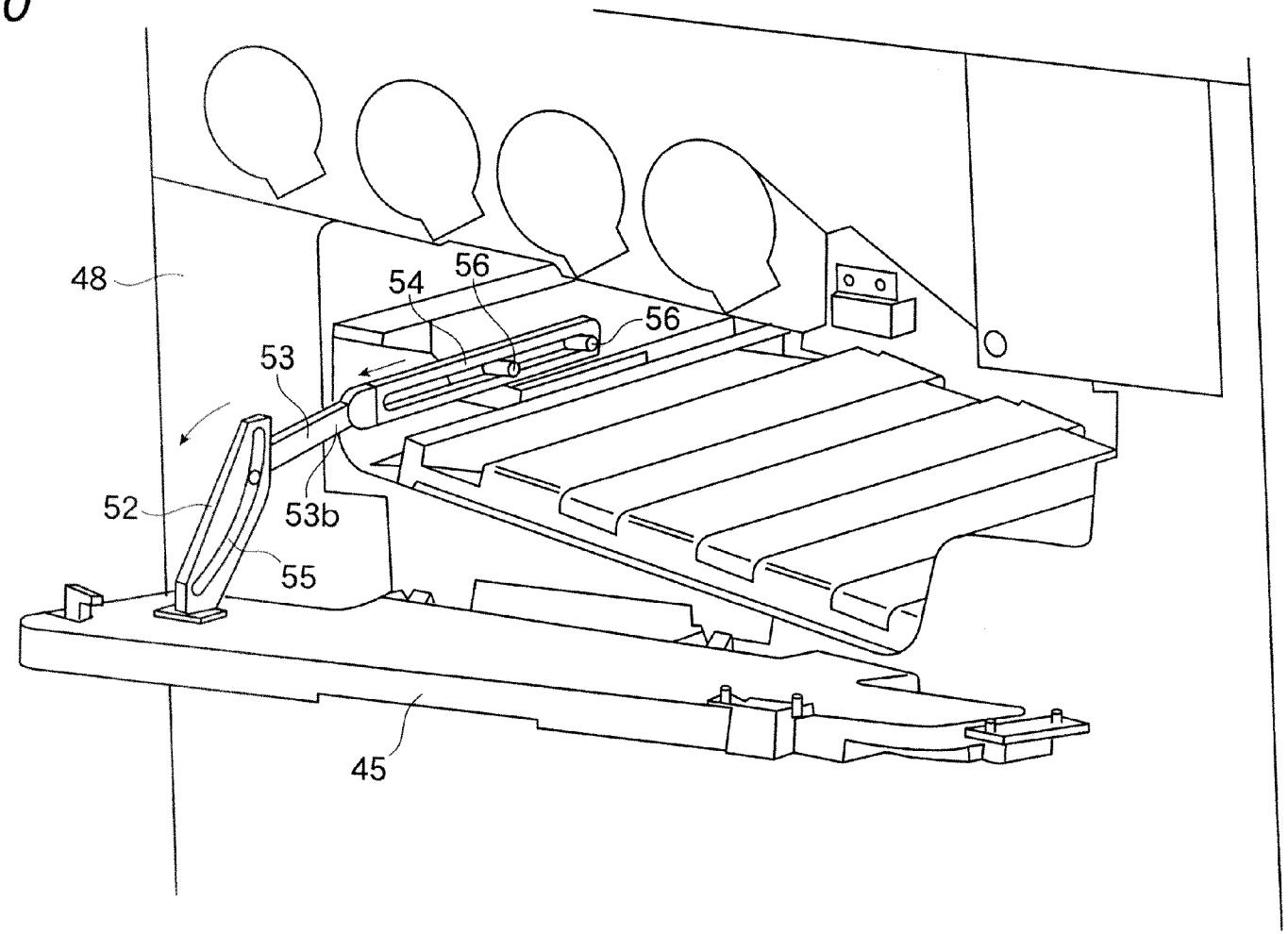
FIG. 10 is a perspective schematic view showing a shutter member.

Upon rotation of the inner cover 45 toward the front face of the printer main body 1, as shown in FIGS. 6 and 10, the first link 52 attached to the inner cover 45 is rotated in a counterclockwise direction in FIG. 6, and the second link 53 fitted into the groove section 55 of this first link 52 is moved toward the front of the printer main body 1 while being rotated in response to the rotational operation of the first link 52 as shown in FIG. 10. In addition, the third link 54 connected to the base end 53*a* of this second link 53 is also moved toward the front face of the printer main body 1.

Figure 11:
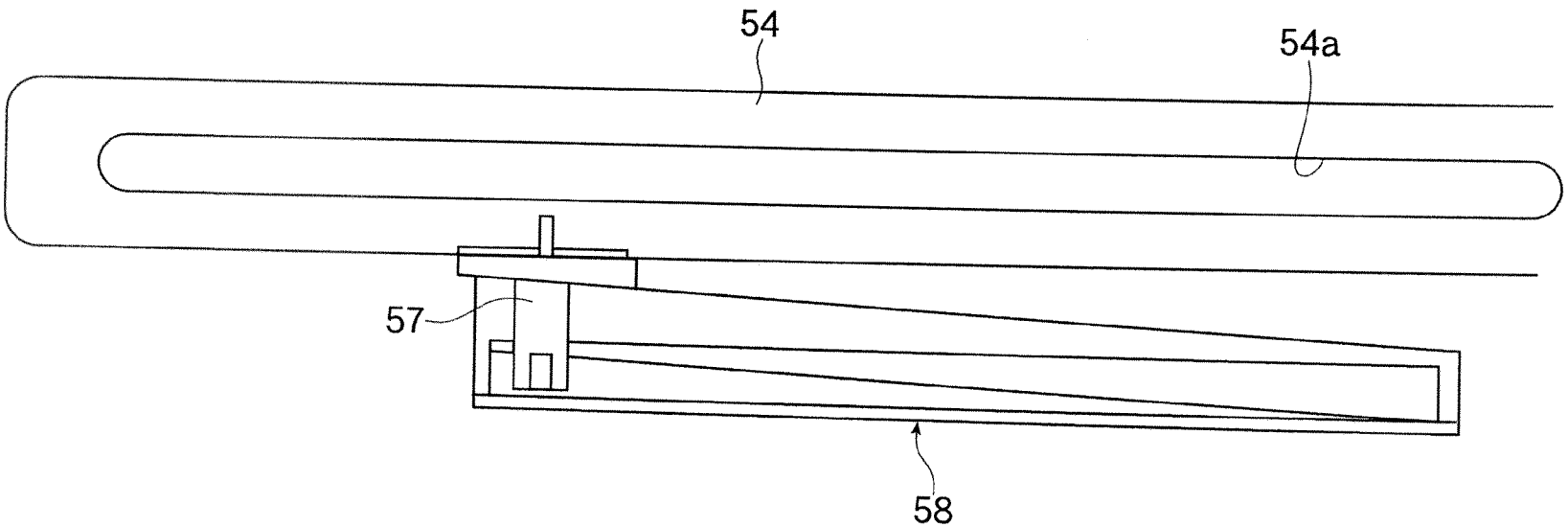
FIG. 11 is a lateral view showing a cam member.
Figure 12:
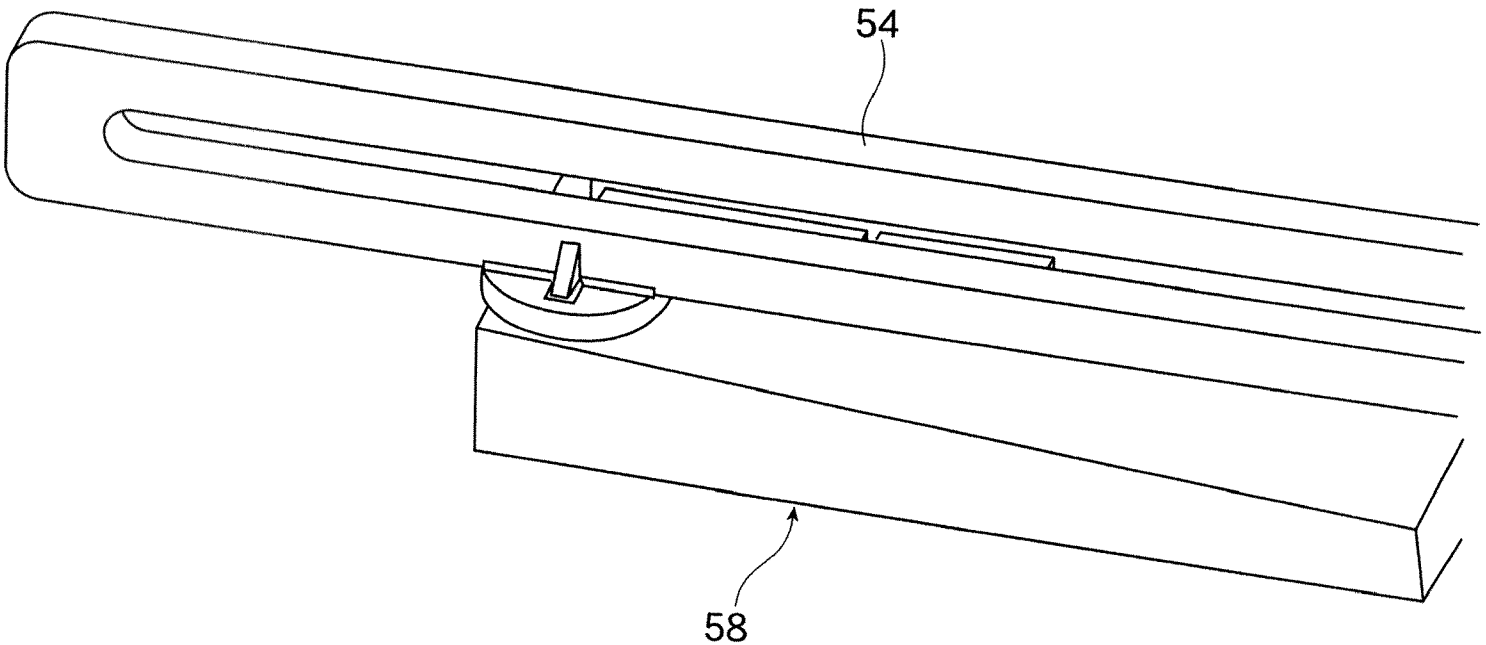
FIG. 12 is a perspective schematic view showing the cam member.
Figure 13:
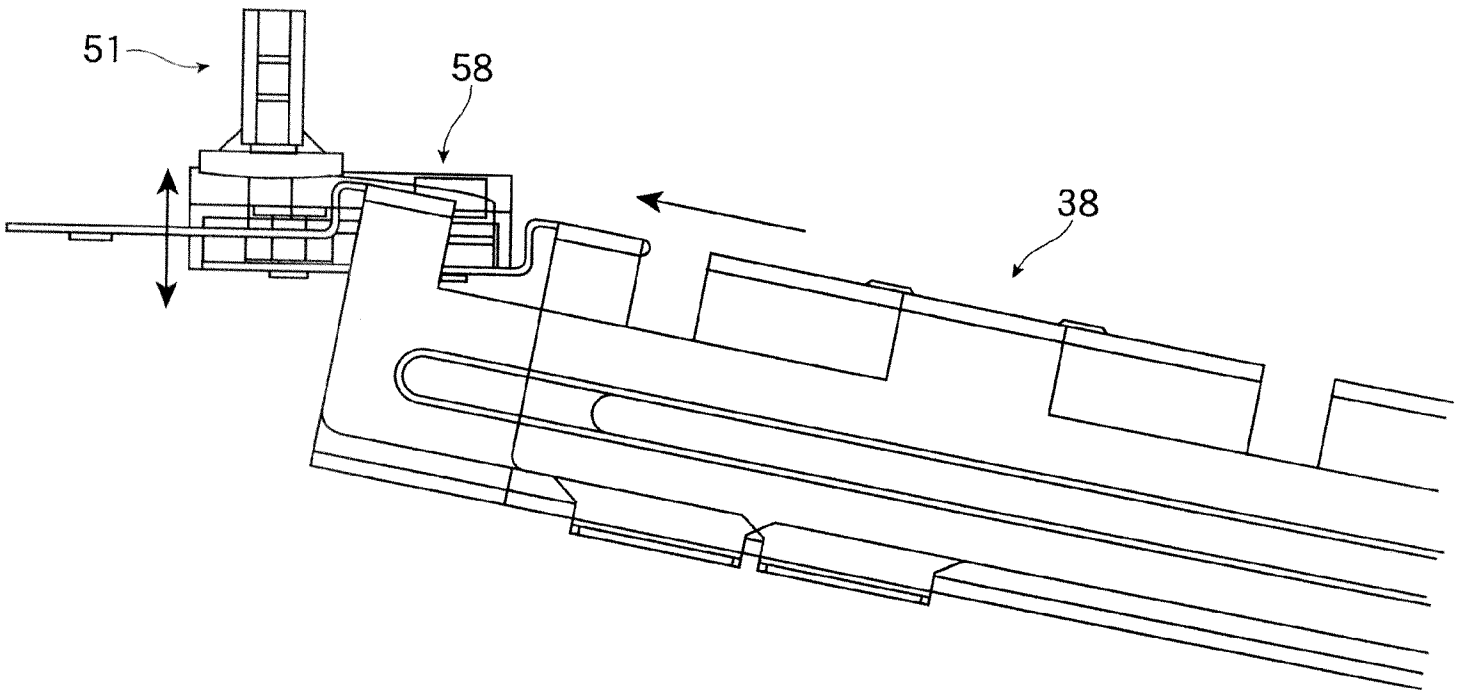
FIG. 13 is a perspective schematic view showing how a shutter member is moved.

Then, the cam follower member 57, provided at the lower end of the third link 54 so as to be protruded downward, slides toward the front face of the printer main body 1 together with the third link 54. This cam follower member 57 is fitted into a guide groove 59 farmed into a curved shape at the cam member 58. Further, as shown in FIGS. 11 and 12, the guide groove 59 is obliquely provided so as to be located at a higher position toward the front face of the printer main body 1. Therefore, upon sliding of the cam follower member 57 toward the front face of the printer main body 1, the cam member 58 is moved so as to be gradually raised while being slid toward the lateral face of the printer main body 1 in the direction indicated by the arrow. Similarly, as shown in FIG. 13, the shutter member 38 attached at its one end to this cam member 58 is moved so as to be gradually raised while being slid toward the lateral face of the printer main body 1 in the direction indicated by the arrow.

Figure 1:
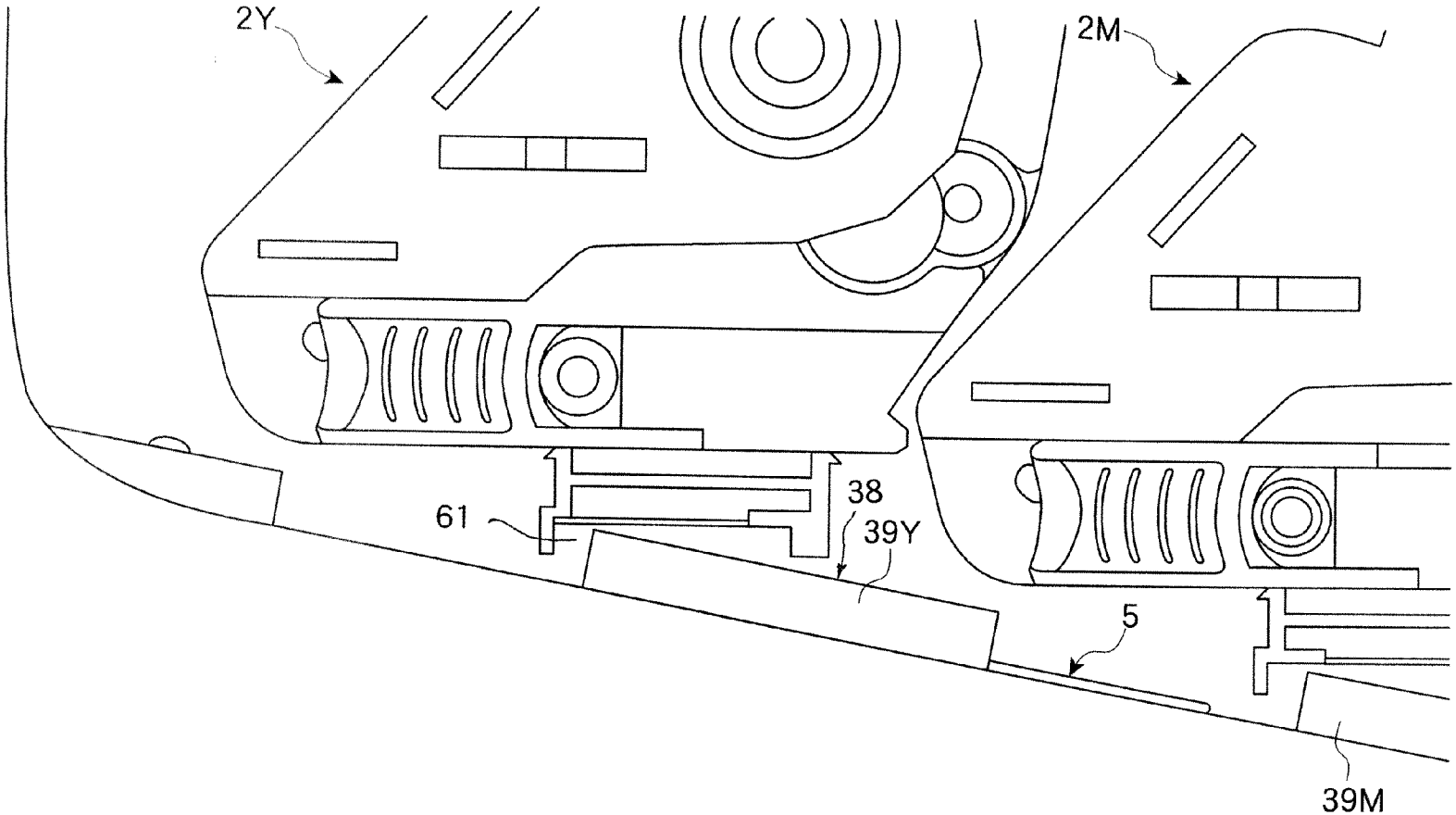
FIG. 1 is a schematic diagram showing a part of a tandem-type full-color printer serving as an image forming apparatus according to exemplary Embodiment 1 of the present invention.
Figure 14:
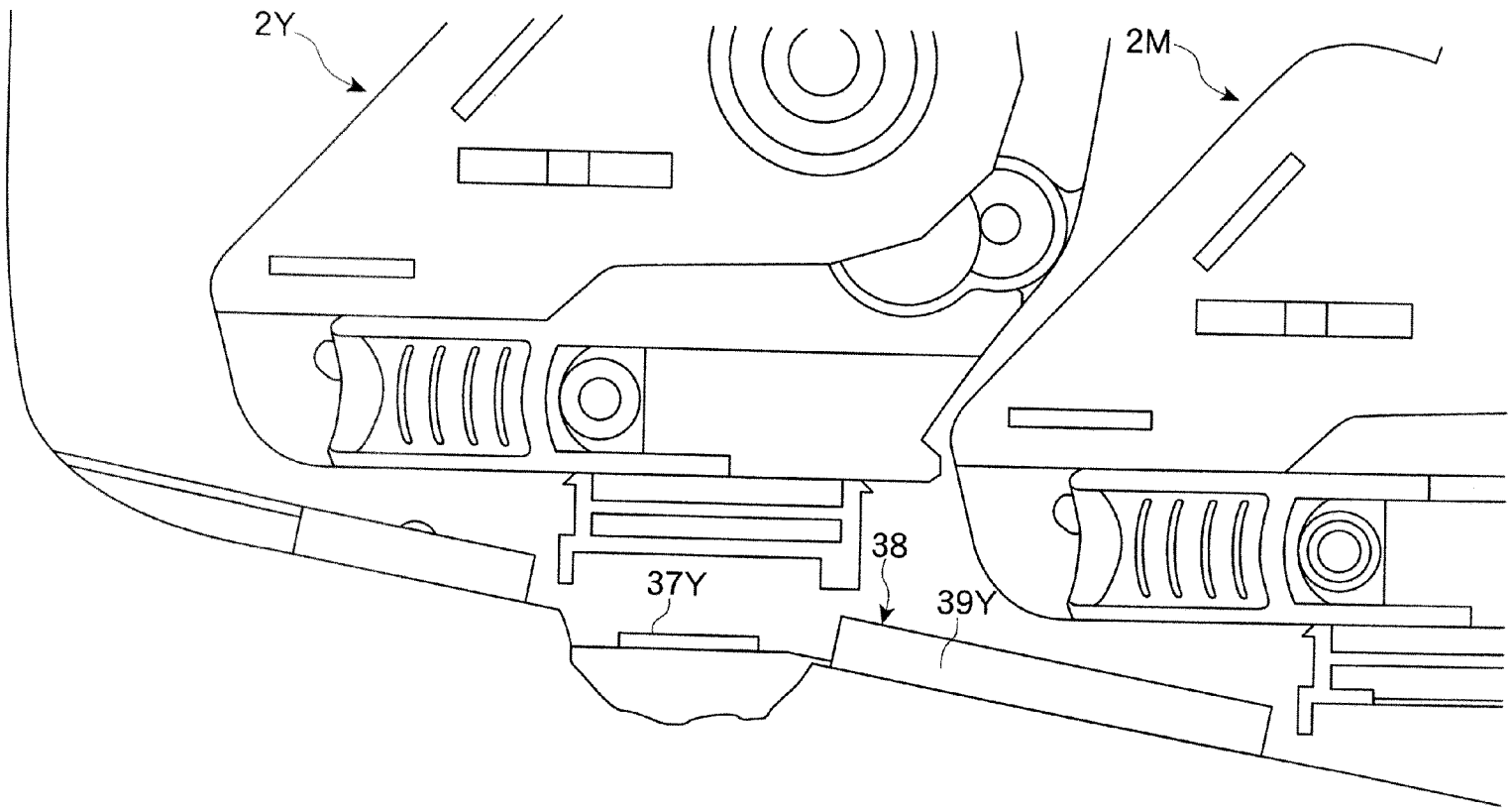
FIG. 14 is a schematic diagram showing a part of the tandem-type full-color printer serving as an image forming apparatus according to exemplary Embodiment 1 of the present invention.

As a result, with the inner cover 45 opened, the shutter member 38 shields the dustproof members 37Y, 37M, 37C and 37K of the image exposure apparatus 5 as shown in FIG. 1, and with the inner cover 45 closed, the shutter member 38 opens the exposure windows of the image exposure apparatus 5 as shown in FIG. 14.

Figure 15:
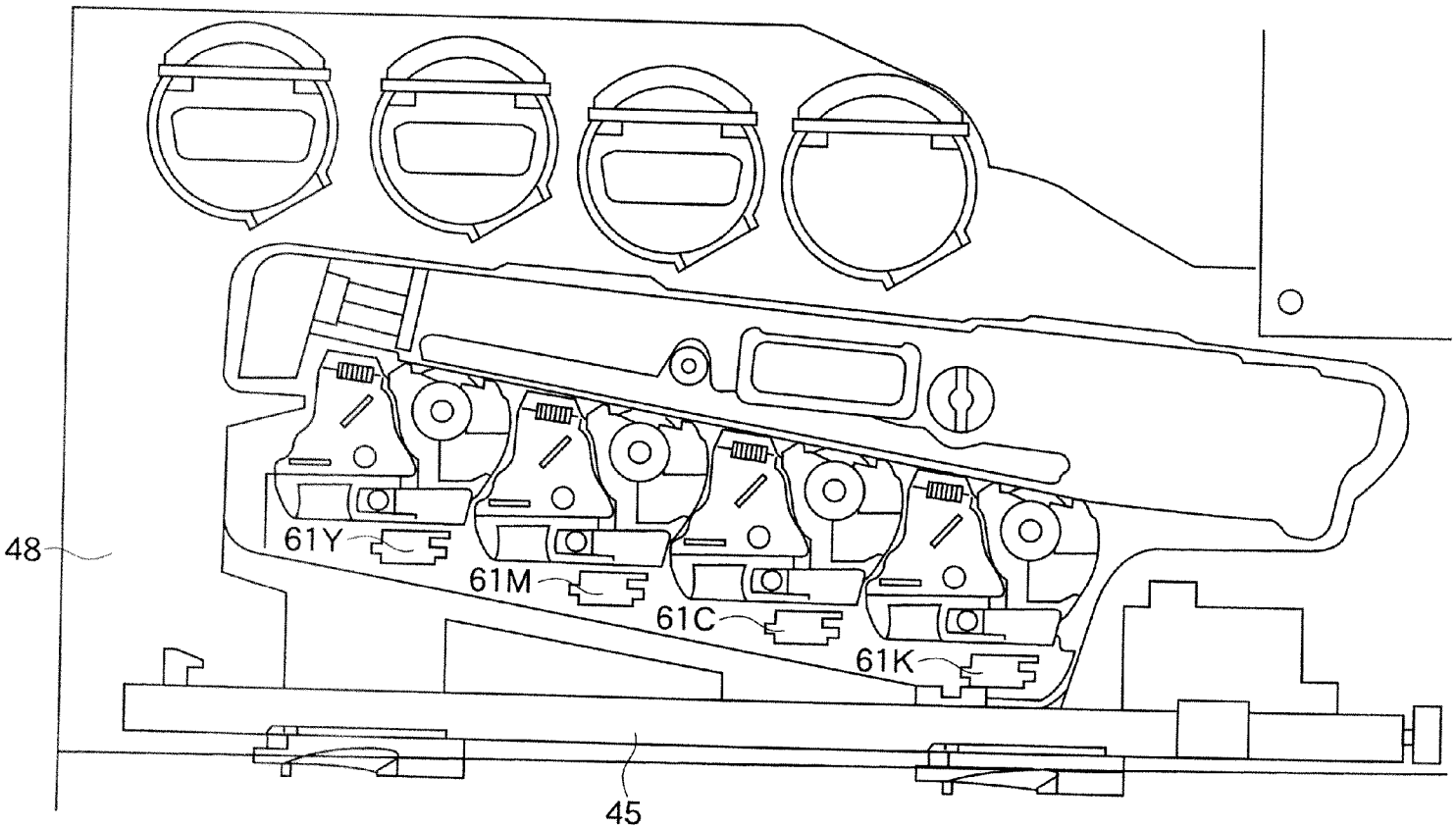
FIG. 15 is a schematic diagram showing a state in which an inner cover of an tandem-type full-color printer serving as an image forming apparatus according to exemplary Embodiment 1 of the present invention is opened.

Further, in this embodiment, there is provided a cleaning member for cleaning the surfaces of the dustproof members 37Y, 37M, 37C and 37K of the image exposure apparatus 5 at predetermined timing, e.g., at the time of replacing the image forming units 2Y, 2M, 2C and 2K. As shown in FIG. 15, the frame 48 of the printer main body 1 is provided, at its position associated with the upper parts of the dustproof members 37Y, 37M, 37C and 37K of the image exposure apparatus 5, with a guide path 61 (61Y, 61M, 61C, 61K) for guiding a cleaning rod 60 serving as the cleaning member. This guide path 61 is formed to extend in parallel with the dustproof members 37Y, 37M, 370 and 37K toward the inside of the printer main body 1, and is formed so as to clean the surfaces of the dustproof members 37Y, 37M, 37C and 37K by the cleaning rod 60 while guiding the cleaning rod 60 inserted into the printer main body 1 along the surfaces of the dustproof members 37Y, 37M, 37C and 37K.

Actually, in this embodiment, as already described above, the opening/closing operation of the shutter member 38 is performed in response to the opening/closing operation of the inner cover 45, which might cause the dustproof members 37Y, 37M, 37C and 37K of the image exposure apparatus 5 to be soiled by a toner or the like. However, this mainly occurs when the image forming units 2Y, 2M, 2C and 2K are replaced with the inner cover 45 opened; accordingly, this embodiment is implemented so that when the inner cover 45 is opened to replace the image forming units 2Y, 2M, 2C and 2K, the shutter member 38 enters the shielding state, thus shielding the surfaces of the dustproof members 37Y, 37M, 37C and 37K.

Therefore, in allowing the dustproof members 37Y, 37M, 37C and 37K to be cleaned by the cleaning rod 60 with the inner cover 45 opened, the surfaces of the dustproof members 37Y, 37M, 37C and 37K are shielded by the shutter member 38 as shown in FIG. 1 while the inner cover 45 is in the opened state. On the other hand, in allowing the dustproof members 37Y, 37M, 37C and 37K to be cleaned without causing the cleaning rod 60 to interfere with the shutter member 38, a large space through which the cleaning rod 60 can be inserted and reciprocated is necessary between the shutter member 38 and the dustproof members 37Y, 37M, 37C and 37K. As a result, the height of the image exposure apparatus 5 including the shutter member 38 is increased, thus making it impossible to achieve the size reduction of the overall full-color printer equipped with the image exposure apparatus 5.

To cope with this, this embodiment is implemented to include: a dustproof member provided at an image exposure window through which an exposure image is formed on a photosensitive material; and a shutter member switched between a shield position for covering a surface of the dustproof member, which serves as a passage region of a cleaning member provided to clean the surface of the dustproof member, and an open position for allowing an exposure image to be formed on a surface of the photosensitive material through the dustproof member, wherein when the shutter member is located at the shield position for covering the surface of the dustproof member, at least a part of the shutter member goes into the passage region of the cleaning member. In this embodiment, the shutter member may be disposed in a position intersecting the passage region of the cleaning member at its shield position.

In other words, in this embodiment, as shown in FIG. 1, the guide path 61, through which the cleaning rod 60 as a cleaning member for cleaning the surfaces of the dustproof members 37Y, 37M, 37C and 37K is guided, is disposed adjacent to the vicinity of the surfaces of the dustproof members 37Y, 37M, 37C and 37K, and the shutter member 38 is formed so that when it is located at the shield position for covering the surfaces of the dustproof members 37Y, 37M, 37C and 37K, at least a part of the shutter member 38 goes into the guide path 61 of the cleaning rod 61.

Figure 16:
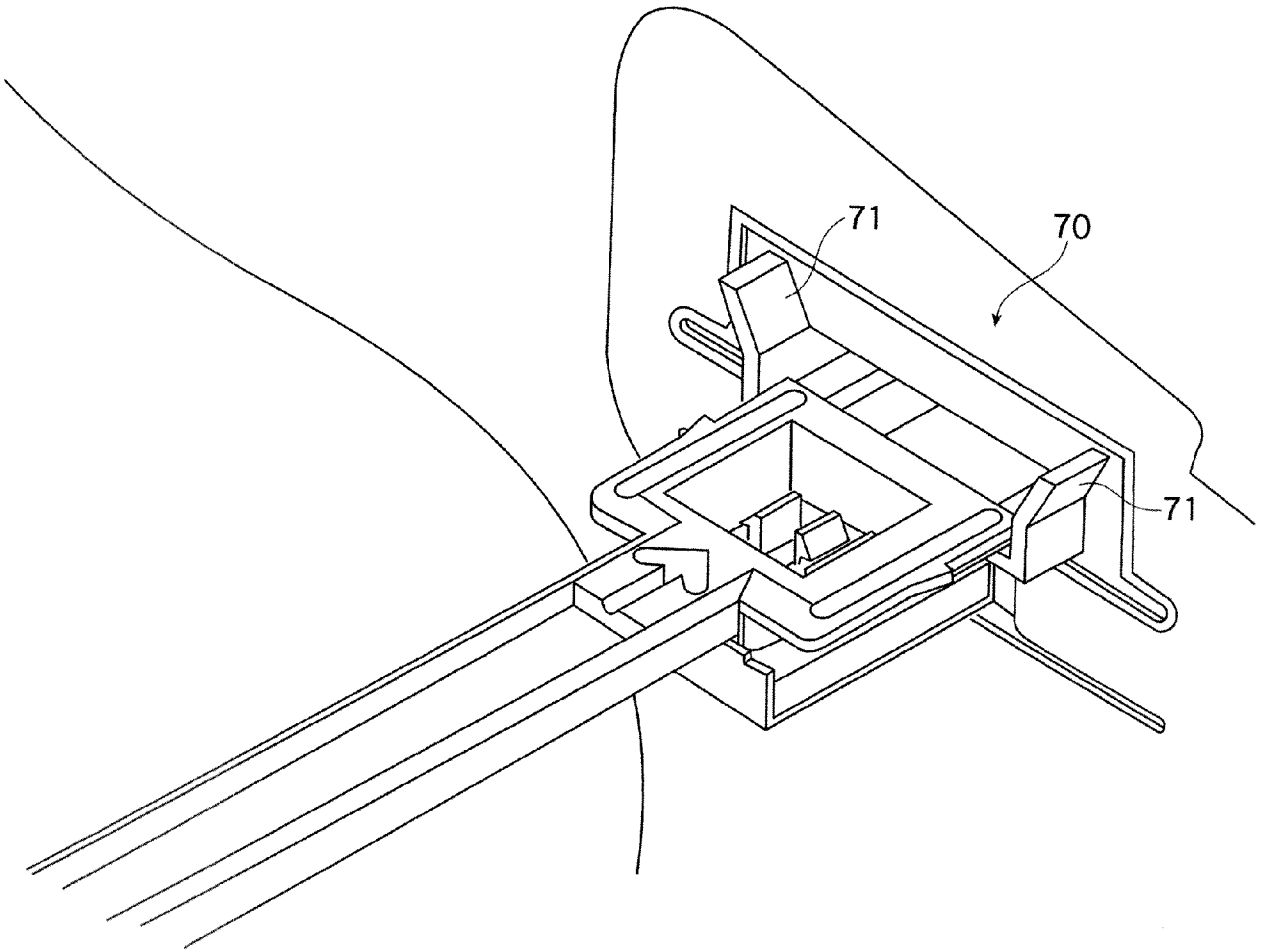
FIG. 16 is a perspective schematic view showing how a cleaning rod is inserted.

Further, in this embodiment, when the surfaces of the dustproof members 37Y, 37M, 37C and 37K are cleaned by the cleaning rod 60, the shutter member 38 has to be opened as shown in FIG. 14. The shutter member 38 is opened since the inner cover 45 is in the closed state, and the cleaning rod 60 is inserted into the guide path 61 to clean the surfaces of the dustproof members 37Y, 37M, 37C and 37K while the inner cover 45 is in the closed state. Wherefore, as shown in FIGS. 8 and 16, the inner cover 45 is provided with an opening section 70 (70Y, 70M, 70C, 70K) through which the cleaning rod 60 is inserted. Furthermore, this opening section 70 is provided with an introduction plate 71, which is opened upward in a tapered manner, in order to guide the cleaning rod 60 into the opening section 70.

Figure 17:
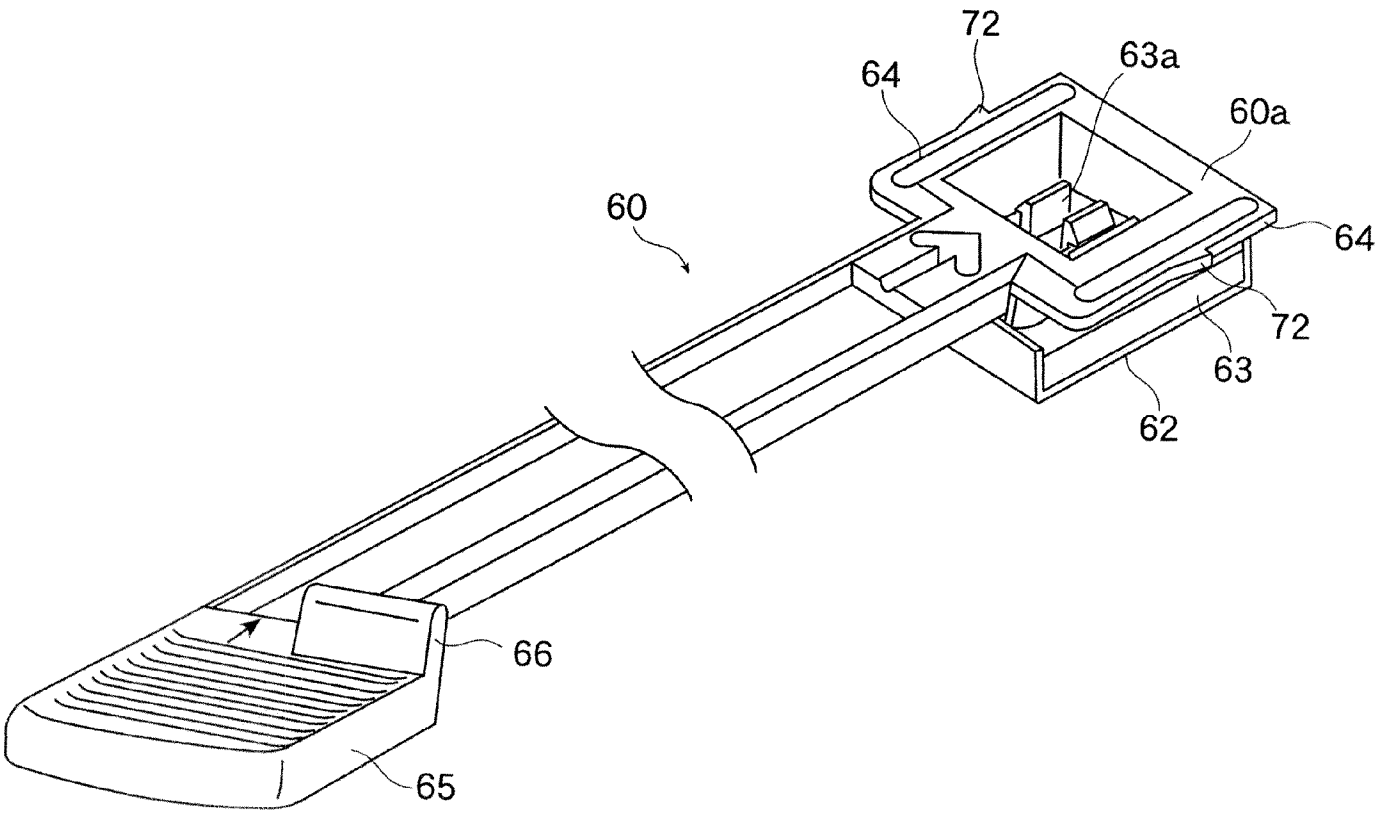
FIG. 17 is a perspective schematic view showing a cleaning rod.
Figure 18:
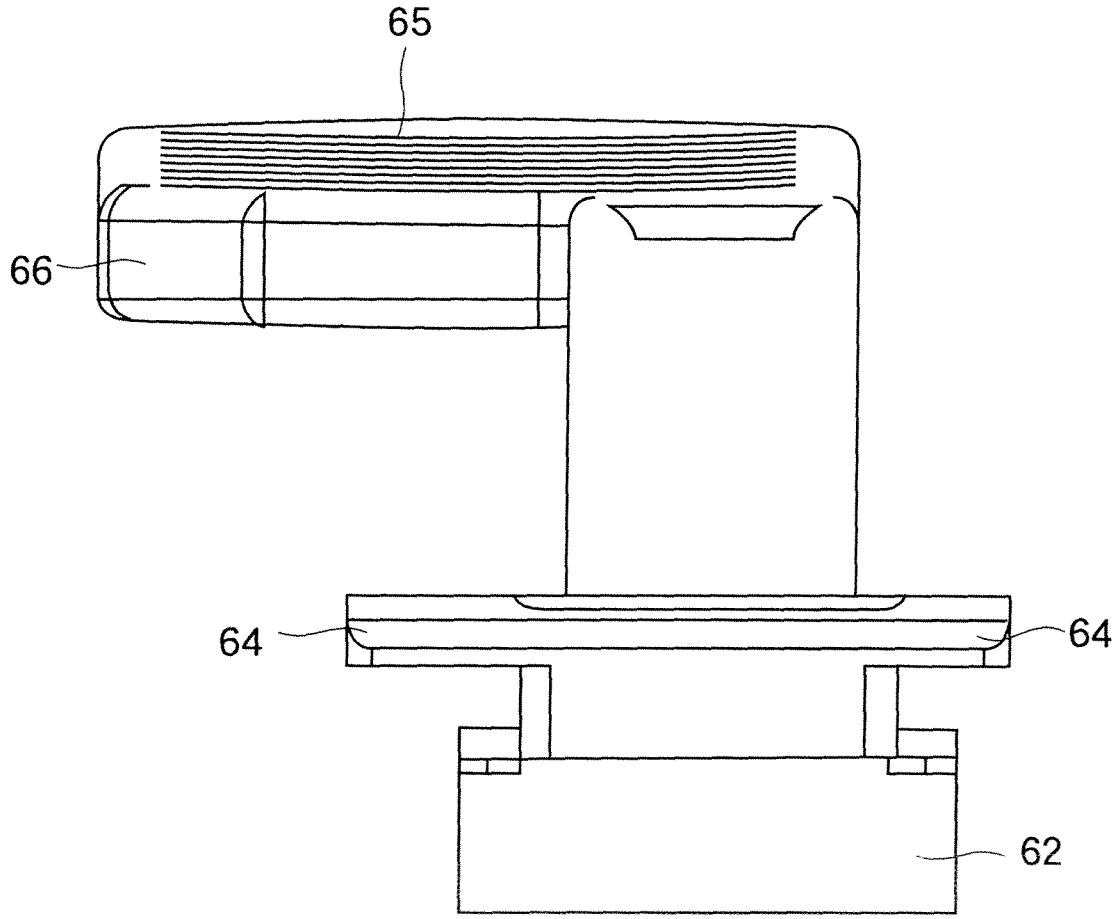
FIG. 18 is a front view showing the cleaning rod.

As shown in FIGS. 17 and 18, the cleaning rod 60 is formed into an elongated rod shape, and is provided, at a lower end face of its front end, with a cleaning sheet 62 consisting of a nonwoven fabric with the cleaning sheet 62 wound around a bottom face and longitudinal front-end and rear-end lateral faces of a retaining member 63 made of synthetic resin or the like. Moreover, the retaining member 63 is engaged with a front end 60*a* of the cleaning rod 60 so as to be replaceable via a snap fit 63*a* or the like. Besides, the front end 60*a* of the cleaning rod 60 is provided, at both right and left sides of its upper end face, with guide sections 64 to be inserted into the guide path 61 of the printer main body 1. It should be noted that the cleaning rod 60 is provided at its base end with a handle section 65 by which a user grasps the cleaning rod 60. In addition, in FIG. 17, the reference numeral 66 represents a stopper.

Actually, this embodiment is implemented so as to include:

a cleaning member provided to clean a surface of a transparent dustproof member provided at an image exposure window through which image exposure is performed on a photosensitive material;

a guide member for guiding the cleaning member to move the cleaning member along the surface of the dustproof member, the guide member including a dedicated frontward path through which the cleaning member is inserted to an end of the dustproof member at the back thereof with the cleaning member located at a distance from the surface of the dustproof member, and a dedicated backward path through which the cleaning member is brought into contact with the surface of the dustproof member to perform cleaning when pulling out the cleaning member inserted to an end of the dedicated frontward path at the back thereof; and a movement direction restricting means, provided at the cleaning member and at least the dedicated frontward path or the dedicated backward path, for restricting a movement direction so that the cleaning member can be moved only in one direction.

Figure 25:
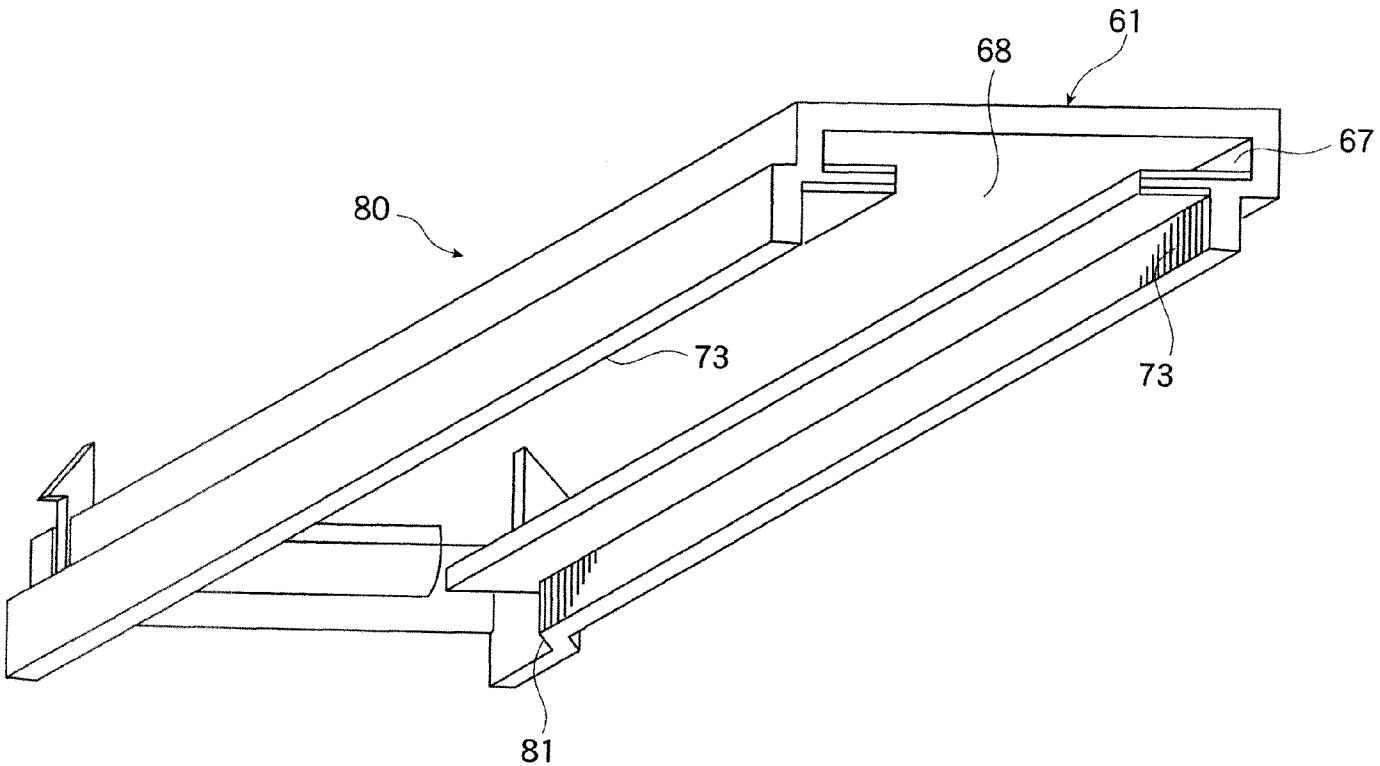
FIG. 25 is a perspective schematic view showing a path forming member.

Specifically, in this embodiment, as shown in FIG. 25, the guide path 61 of the printer main body 1, through which the cleaning rod 60 serving as the cleaning member is inserted, consists of a guide member 80 formed into a long elongated rectangular frame shape along the axial direction of the photosensitive drum 3. The guide path 61 consisting of this guide member 80 includes two upper and lower paths, i.e., a dedicated frontward path 67 located at an upper position, and a dedicated backward path 68 located at a lower position. The upper dedicated frontward path 67 of this guide path 61 serves to move the cleaning rod 60 only when the cleaning rod 60 is inserted to an end of the printer main body 1 at the back thereof; thus, through the upper dedicated frontward path 67, the cleaning rod 60 moves along a position located at a distance from the surfaces of the dustproof members 37Y, 37M, 37C and 37K, and does not clean the surfaces of the dustproof members 37Y, 37M, 37C and 37K. On the other hand, among the guide path 61, the lower dedicated backward path 68 serves to move the cleaning rod 60 only when the cleaning rod 60 is pulled out to an end of the printer main body 1 at the front thereof; thus, through the lower dedicated backward path 68, the cleaning rod 60 is allowed to be pushed down to the lower dedicated backward path 68 by a pushing-down section 69 provided at an end of the upper path 67 at the back thereof.

The guide path 61 is formed by the two upper and lower paths in this manner because if the guide path 61 is formed by only one path, a user can reciprocate the cleaning rod 60 therethrough, which might cause dirt to remain on the surfaces of the dustproof members 37Y, 37M, 37C and 37K due to the reciprocation of the cleaning rod 60 performed by the user. Hence, the guide path 61 is formed by the two upper and lower paths in order to avoid this problem.

It is to be noted that even if the guide path 61 is Stormed by the two upper and lower paths, the user can reciprocate the cleaning rod 60 when the cleaning rod 60 has moved to the lower path. Therefore, in order to surely avoid the reciprocation of the cleaning rod 60 performed by the user, as shown in FIG. 17, the guided portion of the cleaning rod 60 is provided, at its both lateral faces, with protrusion sections 72 each formed into a right angled triangle shape in plan view to face in one direction. In addition, as shown in FIG. 26, the lower dedicated backward path 68 of the guide path 61 is provided, at its both lateral faces, with protrusion sections 73 facing in the same direction as the protrusions of the cleaning rod 60.

Figure 20:
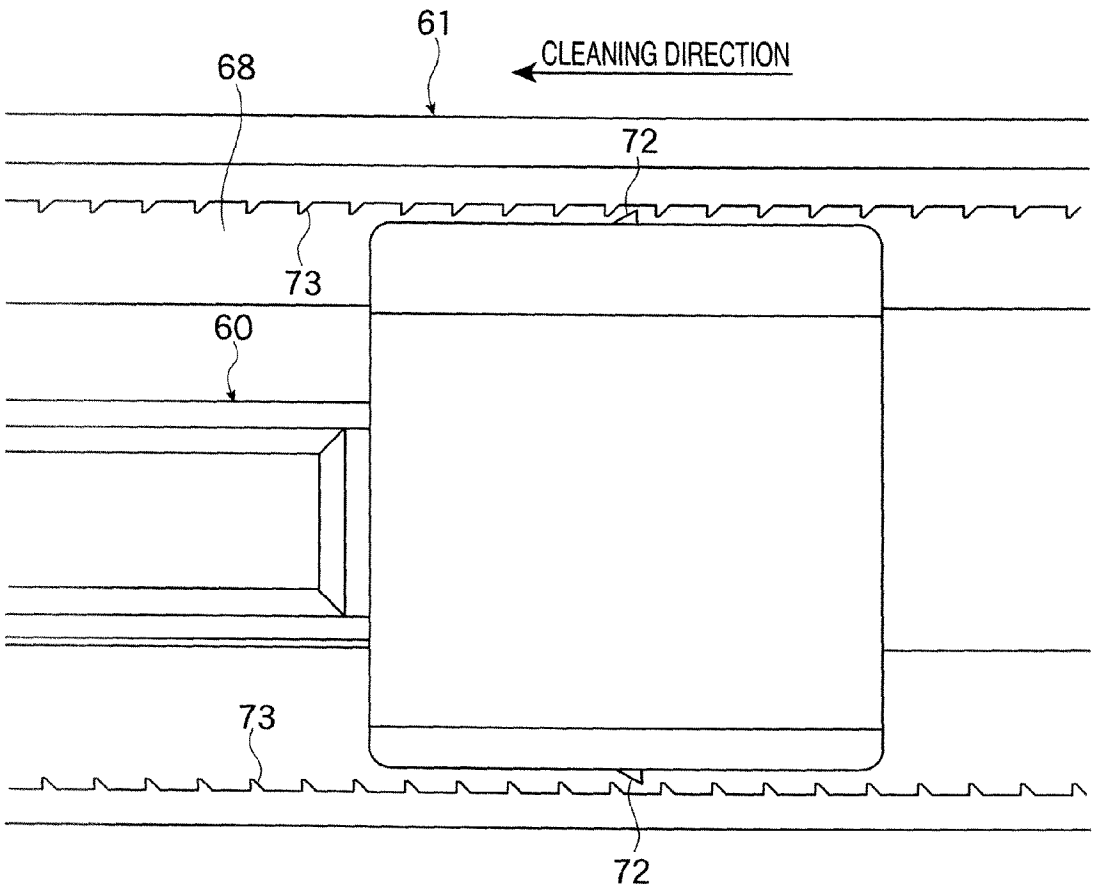
FIG. 20 is a schematic diagram showing a mechanism for preventing returning of a cleaning rod.
Figure 26:
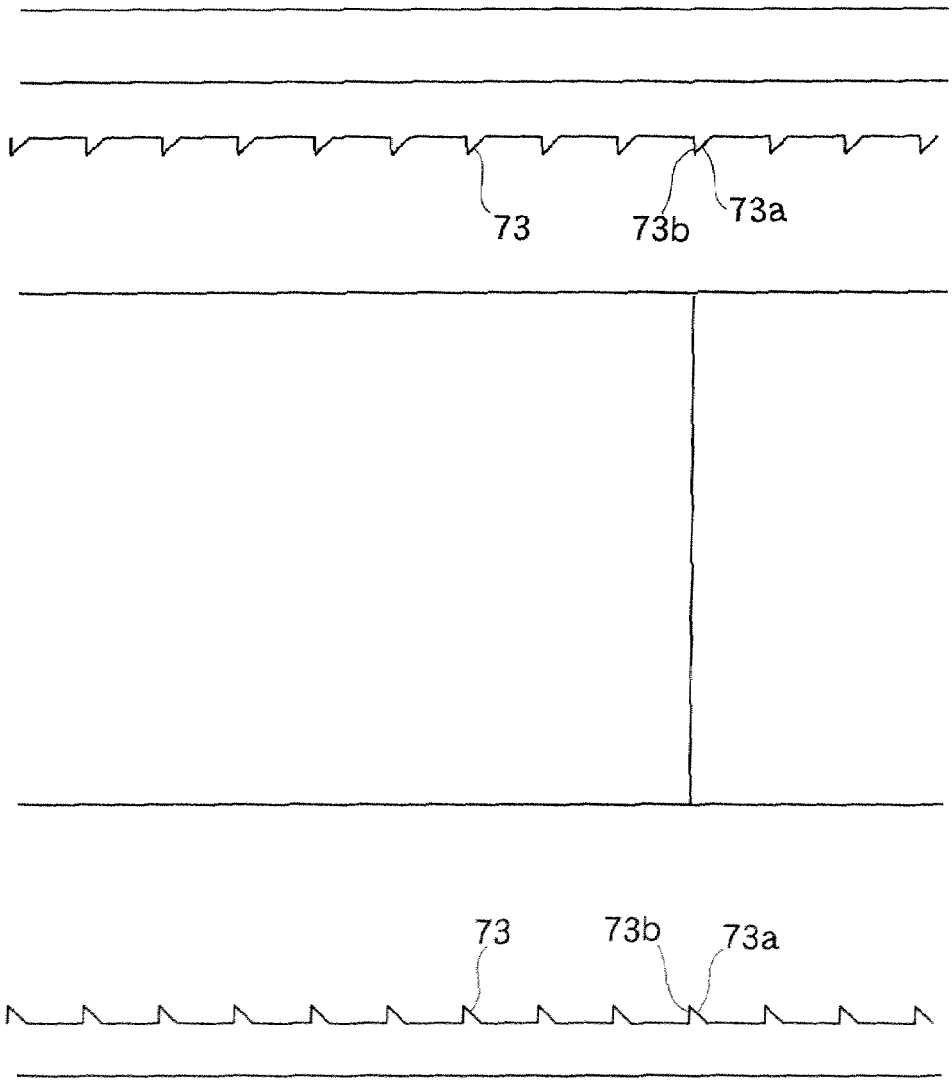
FIG. 26 is a schematic diagram showing a mechanism for preventing returning of a cleaning rod.

As shown in FIGS. 20 and 26, the protrusion sections 72 are each formed into a wedge shape having a first face 72*a* and a second face 72*b*, and the protrusion section 73 are each formed into a wedge shape having a first face 73*a* and a second face 73*b*. The first faces 72*a* and 73*a* allow the movement of the cleaning member by the retreat of one of the first faces 72*a* and 73*a*, and the second faces 72*b* and 73*b* mutually inhibit the movement of the cleaning member when the cleaning member is moved in a direction in which the movement thereof is inhibited, thus constituting a latch mechanism serving as a movement direction restricting means for restricting the movement direction so that the cleaning rod 60 is movable in only one direction.

Figure 19:
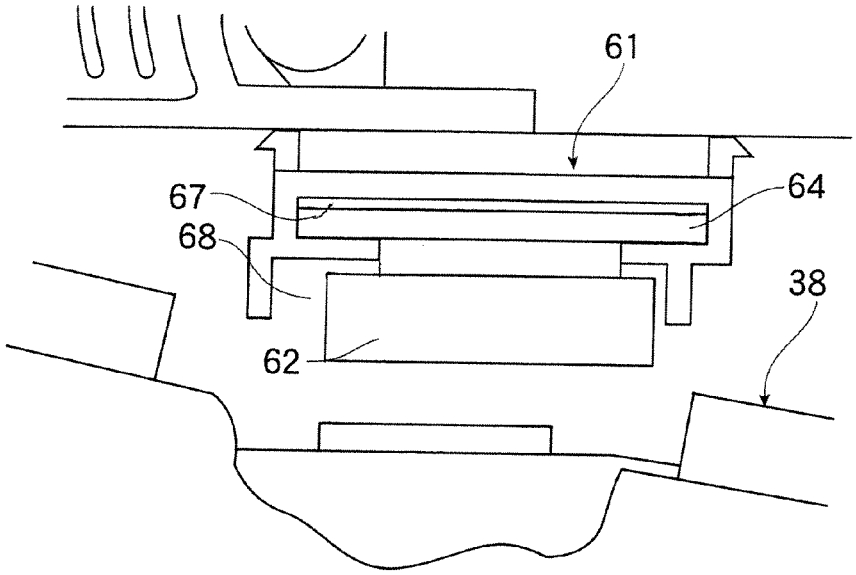
FIG. 19 is a schematic diagram showing how cleaning is carried out by a cleaning rod.
Figure 19:
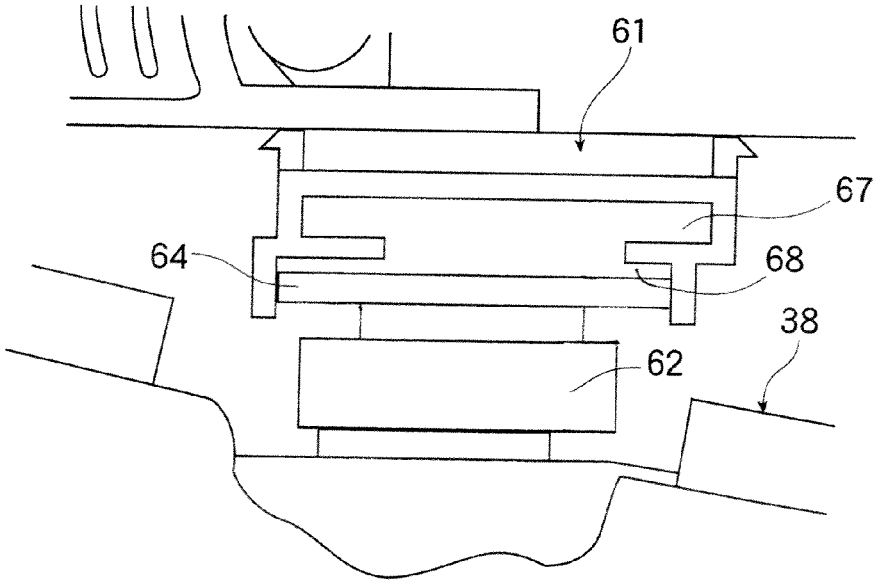

Further, in the illustrated embodiment, the dedicated frontward path 67 and the dedicated backward path 68 are disposed so as to be slightly deviated from each other in a direction orthogonal to the movement direction of the cleaning rod 60, and as shown in FIG. 19, the cleaning rod 60 moving through the dedicated backward path 68 is located at a position corresponding to the surface of the dustproof member 37. It should be noted that as shown in FIG. 25, when the cleaning rod 60 is moved from the upper dedicated frontward path 67 to the lower dedicated backward path 68, an inclined surface 81 provided at an end of the lower dedicated backward path 68 at the back thereof allows the cleaning rod 60 to be smoothly moved to the dedicated backward path 68 disposed so as to be slightly deviated in the direction orthogonal to the movement direction of the cleaning rod 60.

Furthermore, when the user tries to move the cleaning rod 60 toward the back through the lower dedicated backward path 68, the latch mechanism inhibits the movement of the cleaning rod 60 toward the back by engagement of the protrusions 72 of the cleaning rod 60 with the protrusions 73 of the lower guide path 68.

In the structure described above, the full-color printer to which the image exposure apparatus cleaning device according to this embodiment is applied can prevent, as described below, remaining of soil on the surface of the dustproof member and/or excessive wearing away of the cleaning member caused by a situation where when the cleaning member is moved while being guided by the guide member, the cleaning member is move without being brought into contact with the surface of the dustproof member and the surface of the dustproof member is not cleaned, or the cleaning member is unnecessarily reciprocated.

Further, basically, the cleaning rod 60 is used to clean the surfaces of the dustproof members 37Y, 37N, 37C and 37K when the image forming units 2Y, 2M, 2C and 2K are replaced, and it is assumed that the cleaning rod 60 is not replaced after having been used only once, but the cleaning rod 60 is replaced after having been used more than once. Therefore, if the cleaning rod 60 is reused with a toner or the like adhered to the cleaning face 62 of the cleaning rod 60, dirt might remain on the surfaces of the dustproof members 37Y, 37M, 37C and 37K due to the same reason as in the case of the above-described reciprocation.

Figure 21:
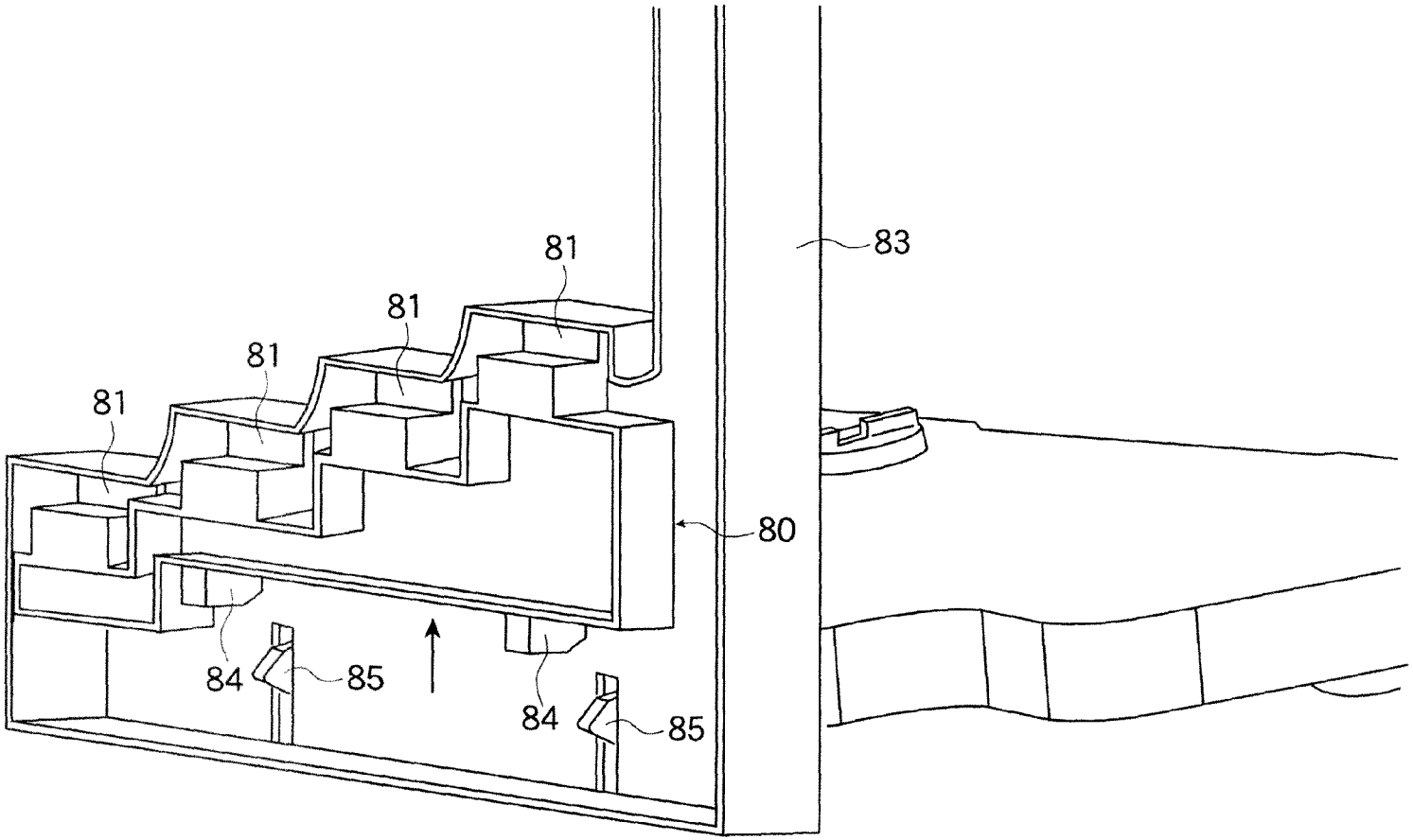
FIG. 21 is a perspective schematic view showing a scraping-off member.
Figure 22:
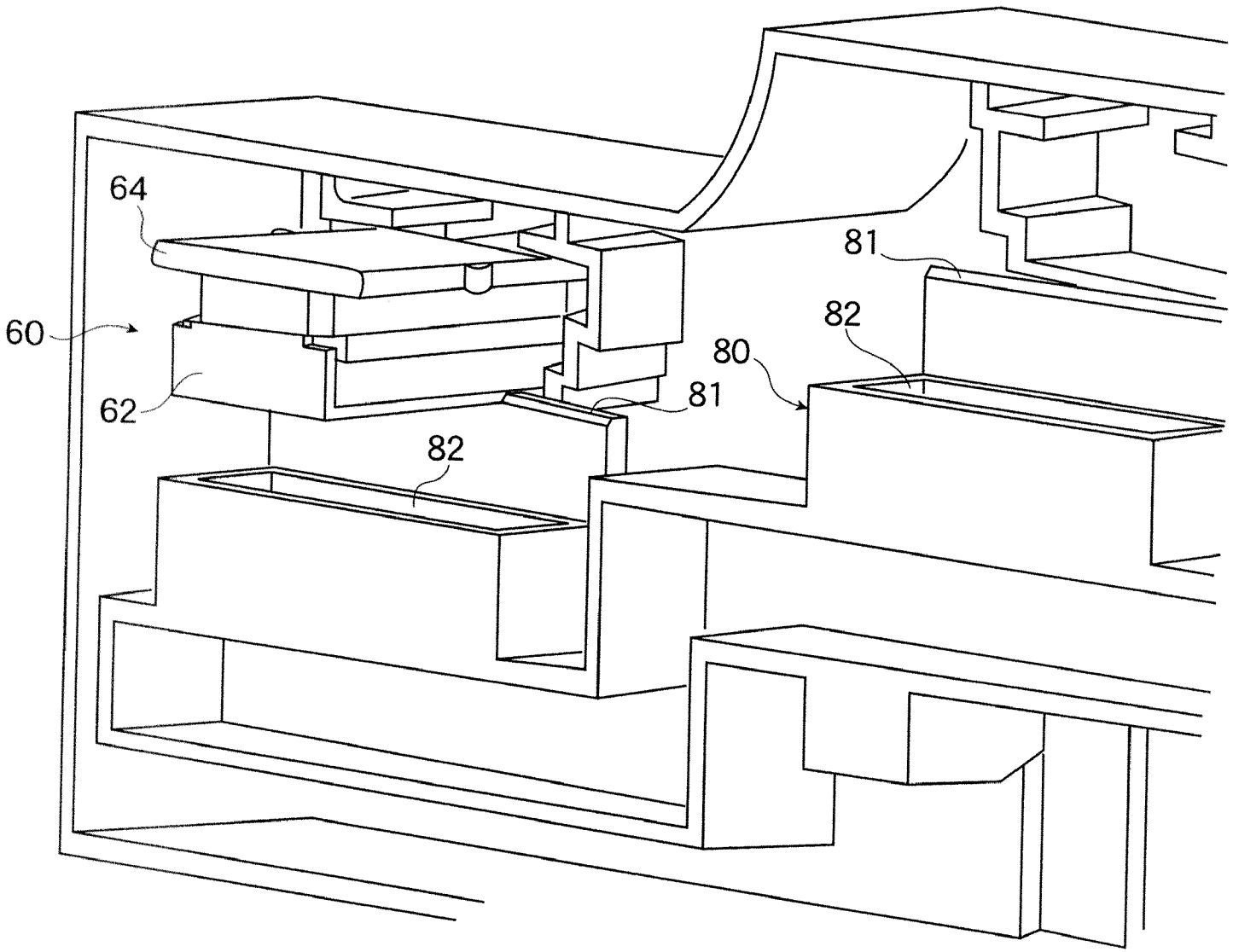
FIG. 22 is a perspective schematic view showing a scraping-off member.
Figure 23:
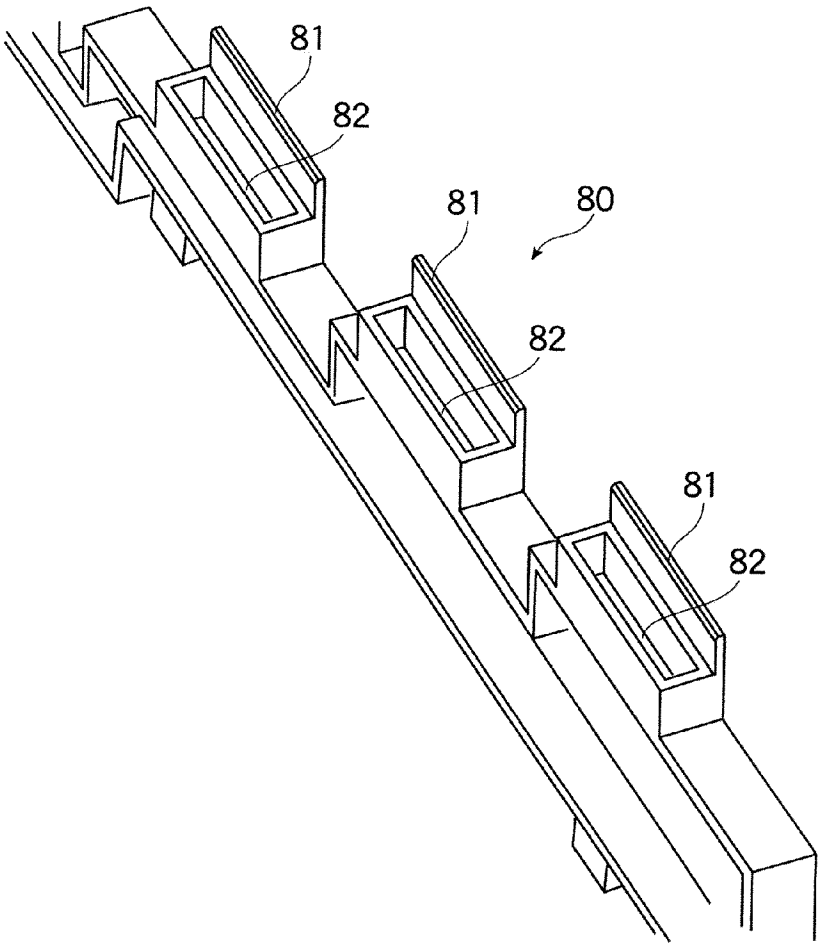
FIG. 23 is a perspective schematic view showing a scraping-off member.

To cope with this, this embodiment is implemented so that when the cleaning rod 60 is pulled out from the printer main body 1, the dirt adhered to the cleaning face of the cleaning rod 60 is scraped off. As shown in FIG. 21, the frame 48 of the printer main body 1 is provided, at the rear side of the guide path 61, with a scraping-off member 80 for scraping off the dirt adhered to the cleaning face of the cleaning rod 60. As shown in FIG. 22, this scraping-off member 80 is provided at a lower end of an exit section of the guide path 61. And as shown in FIG. 23, at positions associated with the exist section of the guide path 61, scraping-off pieces 81 for scraping off the dirt adhered to the cleaning face 62 of the cleaning rod 60 are vertically provided, and at the rear side of each of the scraping-off pieces 81, a collecting box 82 for collecting the scraped off dirt is provided integrally therewith.

Furthermore, as shown in FIG. 21, the scraping-off member 80 also functions as an opening/closing member for opening/closing the guide path 61. As shown in FIG. 15, in the printer main body 1, with the inner cover 45 opened, the guide path 61 is in a state where it is opened to the frame 48. Therefore, with the inner cover 45 opened, the user might erroneously insert the cleaning rod 60 from the guide path 61, and the cleaning rod 60 might interfere with the shutter member 38 and the like inside the printer main body 1 to damage the shutter member 38 and the like.

To cope with this, as shown in FIG. 21, this embodiment is implemented so as to close an inlet section of the guide path 61 by the scraping-off member 80 when the inner cover 45 in the opened state. As shown in FIG. 21, this scraping-off member 80 is retained such that it can slide up and down with respect to a member 83 located at the frame 48 of the printer main body 1, and is formed so that protrusion sections 84 provided at a lower end of the scraping-off member 80 are engaged with protrusion sec tons 85 provided at a lower end of the inner cover 45. Therefore, when the inner cover 45 is in the opened state, the protrusion sections 85 provided at the lower end of the inner cover 45 are engaged with the protrusion sections 84 provided at the lower end of the scraping-off member 80 to push up the scraping-off member 80, thereby allowing the guide path 61 of the printer main body 1 to be closed by the scraping-off pieces 81 of the scraping-off member 80.

In the structure described above, the full-color printer, to which the image exposure apparatus according to this embodiment is applied, reduces the size of the height of the image exposure apparatus or the image forming apparatus as described below, as compared with a case where a shutter member does not go into a passage region, through which a cleaning member passes, in a state in which a transparent member provided at an exposure window is covered.

Specifically, as shown in FIGS. 2 and 3, in the full-color printer according to this embodiment, the image exposure apparatus 5 forms exposure images on the photosensitive drums 3Y, 3M, 3C and 3K of the respective yellow (Y), magenta (M), cyan (C) and black (K) image forming units 2Y, 2M, 2C and 2K in accordance with image data of the respective colors. Then, electrostatic latent images are formed on the surfaces of these photosensitive drums 3Y, 3M, 3 and 3K in accordance with the image data of respective yellow (Y), magenta (M), cyan(C) and black (K) colors, and the electrostatic latent images formed on the surfaces of the respective photosensitive drums 3Y, 3M, 3C and 3K are developed by the developing instruments 6Y, 6M, 6C and 6K, thereby forming toner images of the associated colors.

After having been multi-transferred on the intermediate transfer belt 10, these toner images of the respective yellow (Y), magenta (M), cyan (C) and black (K) colors formed on the photosensitive drums 3Y, 3M, 3C and 3K are secondarily transferred on the recording sheet 18 and fused by the fuser 19, and then the recording sheet 18 is discharged onto the discharge tray provided at the upper part of the printer main body 1.

Actually, in the full-color printer, while a printing operation is continued for a long period of time, the photosensitive drums 3Y, 3M, 3C and 3K might wear away at their surfaces to reach their end of life; therefore, when the photosensitive drums 3Y, 3M, 3C and 3K have reached their end of life, the image forming units 2Y, 2M, 2C and 2K including the photosensitive drums 3Y, 3M, 3C and 3K have to be replaced.

In the full-color printer, in replacing the image forming units 2Y, 2M, 2C and 2K with the front cover 46 of the printer main body 1 opened as shown in FIG. 8, the operation levers 49 and 50 of the inner cover 45 are rotated to the open positions, thereby allowing the inner cover 45 to be opened toward the front of the printer main body as shown in FIG. 10.

Then, in the printer, among the image forming units 2Y, 2M, 2C and 2K exposed to the front face of the printer main body 1 as shown in FIG. 15, the image forming unit 2 whose photosensitive drum 3 is to be replaced is pulled out to the front, and is replaced with a new image forming unit 2. At this time, since the photosensitive drum 3 of the image forming unit 2 is adjacent to the developing instrument 6, at the time of replacing the image forming unit 2, a toner adhered to the photosensitive drum 3 and/or a toner located at an opening section of the developing instrument 6 might fall down on the dustproof member 37 of the image exposure apparatus 5 located therebelow as shown in FIG. 14, which might dirt the surface of the dustproof member 37.

To cope with this, in this embodiment, as shown in FIG. 10, the shutter member 38 is closed in response to the opening operation of the inner cover 45, and as shown in FIG. 1, the dustproof member 37 of the image exposure apparatus 5 is allowed to be shielded by the shutter section 39 of the shutter member 38.

Hence, when replacing the image forming unit 2, even if a toner adhered to the photosensitive drum 3 and/or a toner located at the opening section of the developing instrument 6 have/has fallen down, the dustproof member 37 is shielded by the shutter section 39 of the shutter member 38, thus avoiding a situation where the dustproof member 37 of the image exposure apparatus 5 is soiled by a toner or the like.

Further, as shown in FIG. 1, the present embodiment is implemented so that the shutter section 39 of the shutter member 38 goes into the guide path 61 of the cleaning rod 60 when shielding the dustproof member 37 of the image exposure apparatus 5. Therefore, in the case of a normal printer, since the dustproof member 37 of the image exposure apparatus 5 is cleaned by the cleaning rod 60 with the shutter section 39 of the shutter member 38 closed, it is necessary to avoid the interference between the shutter member 38 and the moving route of the cleaning rod 60, and a large space has to be provided between the shutter member 38 and the moving route of the cleaning rod 60, resulting in the increase in device size.

To the contrary, as shown in FIG. 14, the present embodiment is implemented so that the dustproof member 37 of the image exposure apparatus 5 is cleaned by the cleaning rod 60 in the state where the inner cover 45 is closed, i.e., in the state where the shutter member 38 operated in response to the operation of the inner cover 45 is opened. Therefore, the present embodiment can be implanted so that the shutter section 39 of the shutter member 38 goes into the guide path 61 of the cleaning rod 60 when shielding the dustproof member 37 of the image exposure apparatus 5. As a result, it is unnecessary to provide a large space between the shutter member 38 and the moving route of the cleaning rod 60, thus reducing the image exposure apparatus 5 and the printer in size.

Figure 24:
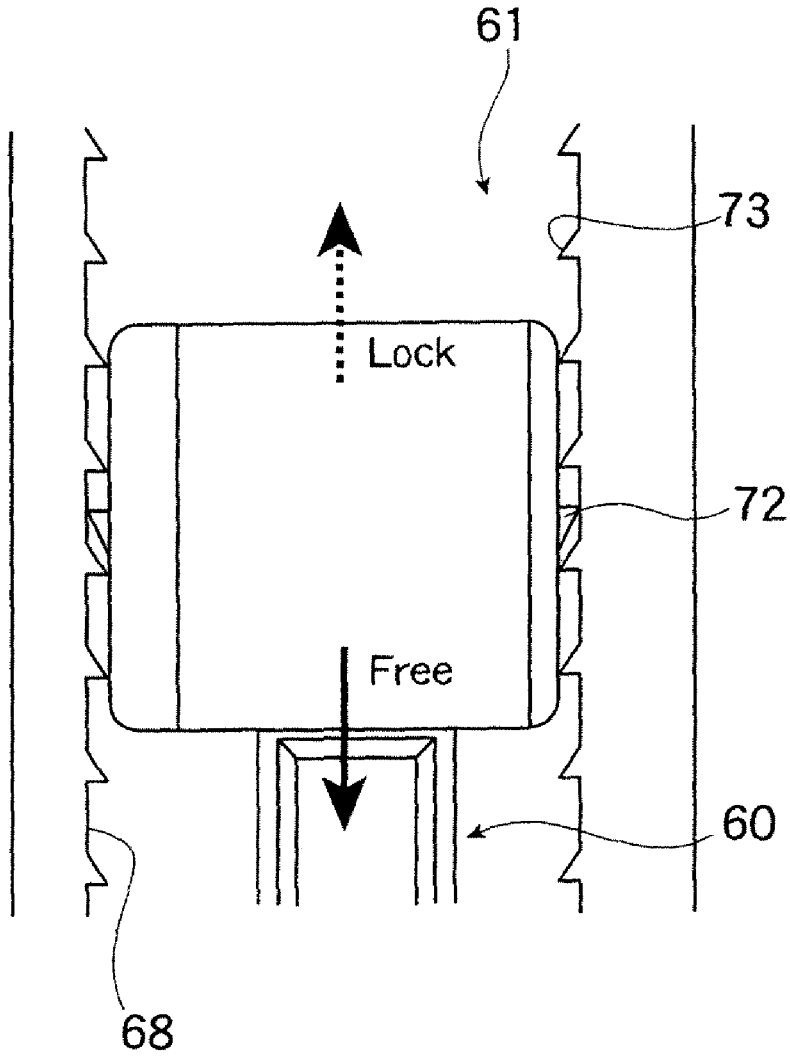
FIG. 24 is a schematic diagram showing a part of an image exposure apparatus cleaning device according to exemplary Embodiment 1 of the present invention.

Moreover, in the foregoing embodiment, as shown in FIG. 24, there is provided the cleaning rod 60 for cleaning the surface of the dustproof member 37 of the image exposure apparatus 5. When moving through the lower dedicated backward path 68 of the guide path 61, this cleaning rod 60 can move only toward the front of the printer main body 1 due to the latch mechanism consisting of the protrusion sections 72 and 73. Therefore, it is possible to prevent remaining of soil such as a toner on the surface of the dustproof member 37 and excessive wearing away due to unnecessary reciprocation of the cleaning rod 60, which occur when a user has erroneously cleaned the surface of the dustproof member 37 by reciprocating the cleaning rod 60.

Embodiment 2

Figure 27:
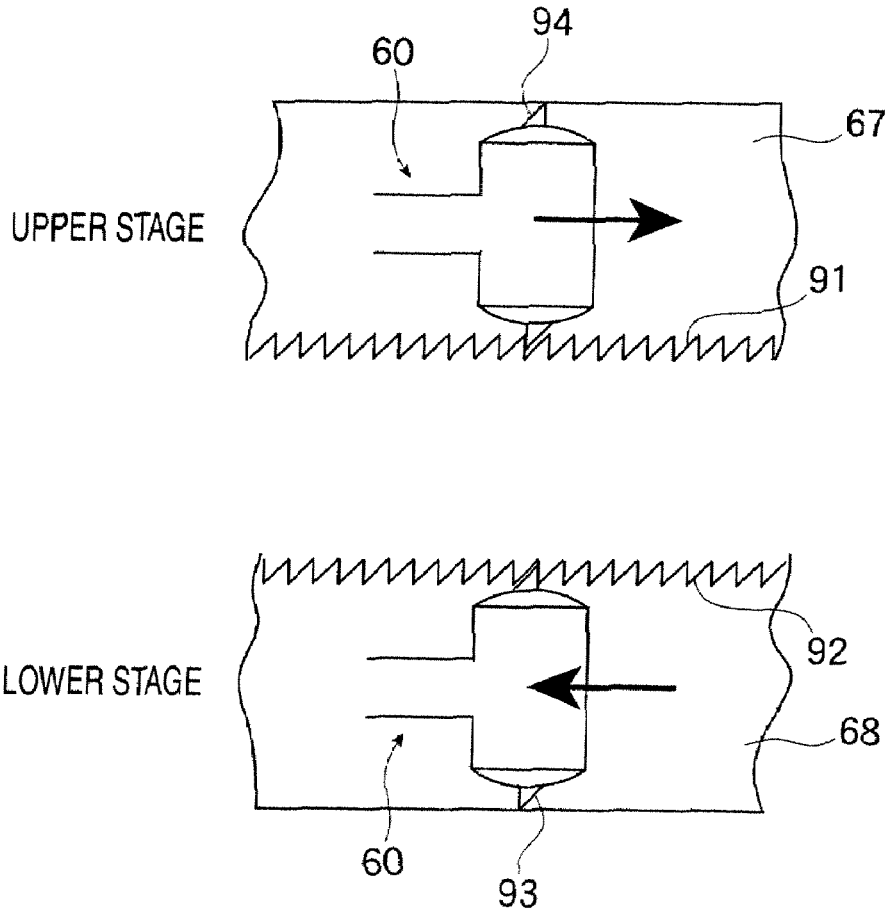
FIG. 27 is a schematic diagram showing an image exposure apparatus cleaning device according to exemplary Embodiment 2 of the present invention.
Figure 28:
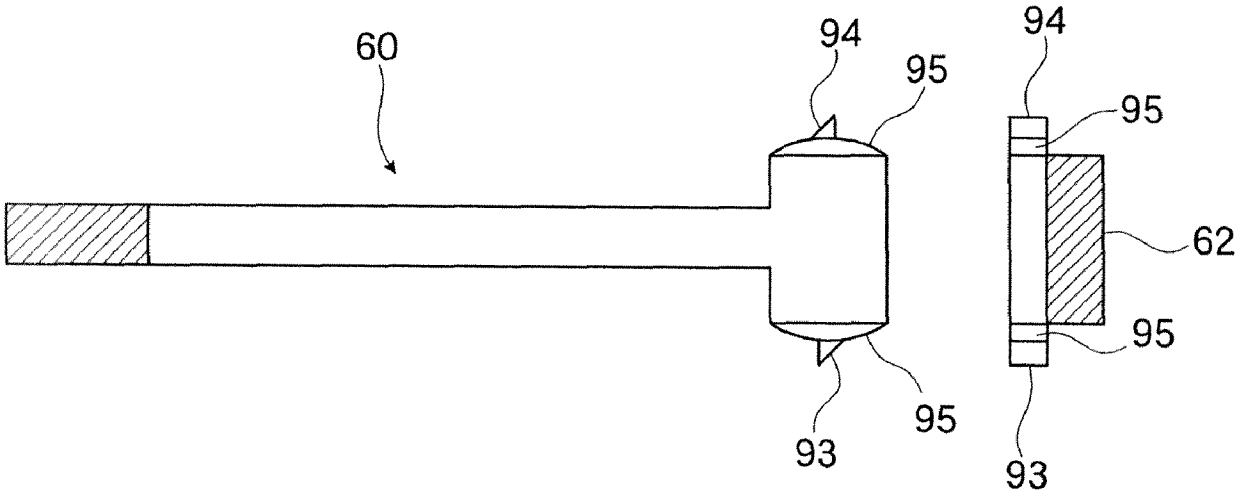
FIG. 28 is a schematic diagram showing an image exposure apparatus cleaning device according to exemplary Embodiment 2 of the present invention.

FIGS. 27 and 28 show exemplary Embodiment 2 of the present invention, and Embodiment 2 will be described below with the same reference numerals assigned to the same sections as in Embodiment 1 described above. Embodiment 2 is implemented so that the latch mechanism is provided at both of the dedicated frontward path and dedicated backward path of the guide member.

Specifically, in Embodiment 2, as shown in FIGS. 27 and 28, a latch mechanism 8 Is provided at both of the upper dedicated frontward path 67 and lower dedicated backward path 68 of the guide path 61, and is formed so that the upper dedicated frontward path 67 allows only the movement of the cleaning rod 60 in an insertion direction, while the lower dedicated backward path 68 allows only the movement of the cleaning rod 60 in a pull-out direction.

More specifically, as shown in FIG. 27, the upper dedicated frontward path 67 of the guide path 61 is provided, only at its one lateral face, with a latch mechanism consisting of protrusion sections 91, and the lower dedicated backward path 68 is provided, only at its other lateral face, with a latch mechanism consisting of protrusion sections 92. Further, as shown in FIG. 25, the cleaning rod 60 is provided, at its one lateral face, with a protrusion section 93 facing correspondingly to the protrusion sections 91 of the dedicated frontward path 67, and the cleaning rod 60 is provided, at its other lateral face, with a protrusion section 94 facing correspondingly to the protrusion sections 92 of the dedicated backward path 68. It should be noted that in FIG. 28, the reference numeral 95 represents plate springs for retaining the protrusion sections 93 and 94 of the cleaning rod 60 in such a manner that they can be elastically displaced in a retreating direction.

The protrusion sections 91 of the upper dedicated frontward path 67 and the protrusion Sections 92 of the lower dedicated backward path 68 may be set so that pitches at which the wedge shape protrusion sections 91 are arranged and sizes of the wedge shape protrusion sections 91 become equal to pitches at which the wedge shape protrusion sections 92 are arranged and sizes of the wedge shape protrusion sections 92. However, the protrusion sections 91 of the upper dedicated frontward path 67 and the protrusion sections 92 of the lower dedicated backward path 68 may be set so that pitches at which the wedge shape protrusion sections 91 are arranged and sizes of the wedge shape protrusion sections 91 differ from pitches at which the wedge shape protrusion sections 92 are arranged and sizes of the wedge shape protrusion sections 92.

Thus, a sound generated when the cleaning rod 60 is engaged with the protrusion sections 91 of the upper dedicated frontward path 67 can be different from a sound generated when the cleaning rod 60 is engaged with the protrusion sections 92 of the lower dedicated backward path 68, thereby allowing a user to ascertain from a sound generated by the latch mechanism that the insertion operation and pull-out operation of the cleaning member are surely carried out.

The other structures and operations are similar to those of Embodiment 1 described above, and therefore, the description thereof will be omitted.

What is claimed is:

1. An image exposure apparatus comprising:

an optical unit that emits light to form an exposure image on a photosensitive material;

a casing that houses the optical unit and that has an image exposure window through which the light is allowed to pass for forming the exposure image;

a transparent dustproof member at the image exposure window; and a shutter member switched between a shield position for covering a region above the dustproof member, which serves as a passage region of a cleaning member for cleaning a surface of the dustproof member, and an open position for allowing the light to pass through the dustproof member to form an exposure image on a surface of the photosensitive material, wherein when the shutter member is located at the shield position, at least a part of the shutter member goes into the passage region of the cleaning member, wherein the cleaning member is guided by a guide path formed in a frame of the image forming apparatus main body toward the inside of the image forming apparatus main body, and the cleaning member is inserted into an opening section formed in an inner cover of the image forming apparatus main body.

2. The image exposure apparatus according to claim 1, wherein the shutter member is switched between the shield position and the open position in response to a movement of a fixing member that replaceably fixes the photosensitive material.

3. The image exposure apparatus according to claim 1, wherein the fixing member is provided inside an image forming apparatus main body in an openable and closable manner, and serves as an inner cover for fixing an end of the photosensitive material, the inner cover being provided with an opening section communicated with the passage region of the cleaning member.

4. The image exposure apparatus according to claim 1, wherein the passage region of the cleaning member includes: a region through which the cleaning member is located at a distance from the dustproof member; and a region through which the cleaning member is brought into contact with the dustproof member, in reciprocating the cleaning member.

5. The image exposure apparatus according to claim 1, wherein the shield position is a position at which the shutter member goes into the passage region of the cleaning member, and the open position is a position at which the shutter member opens the passage region of the cleaning member.

6. The image exposure apparatus according to claim 3, further comprising an opening and closing member that opens and closes an opening section provided at the inner cover, in response to a movement of the fixing member.

7. The image exposure apparatus according to claim 3, further comprising a scraping-off member that scraps off dirt adhered to the cleaning member.

8. The image exposure apparatus according to claim 7, wherein the scraping-off member functions as an opening and closing member that opens and closes an opening section provided at the inner cover.

9. An image forming apparatus comprising:

an image forming apparatus main body a photosensitive material replaceably attached to the image forming apparatus main body;

an image exposure apparatus having an image exposure window through which light for forming an exposure image on the photosensitive material passes;

a transparent dustproof member provided at the image exposure window;

an opening and closing member that is provided at the image forming apparatus main body in an openable and closable manner and that replaceably fixes the photosensitive material; and a shutter member switched, in response to a movement of the opening and closing member, between a shield position for covering a region above the dustproof member, which serves as a passage region of a cleaning member for cleaning a surface of the dustproof member, and an open position for allowing the light to pass through the dustproof member to form an exposure image on a surface of the photosensitive material, wherein when the shutter member is located at the shield position, at least a part of the shutter member goes into the passage region of the cleaning member.

10. An image exposure apparatus comprising:

an optical unit that emits light to form an exposure image on a photosensitive material;

a casing that houses the optical unit and that has an image exposure window through which the light is allowed to pass for forming the exposure image;

a transparent dustproof member at the image exposure window; and a shutter member switched between a shield position for covering a region above the dustproof member, which serves as a passage region of a cleaning member for cleaning a surface of the dustproof member, and an open position for allowing the light to pass through the dustproof member to form an exposure image on a surface of the photosensitive material, wherein when the shutter member is located at the shield position, the shutter member prevents the cleaning member from going into the passage region, wherein the cleaning member is guided by a guide path formed in a frame of the image forming apparatus main body toward the inside of the image forming apparatus main body, and the cleaning member is inserted into an opening section formed in an inner cover of the image forming apparatus main body.

11. An image exposure apparatus cleaning device comprising:

a cleaning member for cleaning a surface of a transparent dustproof member at an image exposure window of an image exposure apparatus through which image exposure is performed on a photosensitive material;

a guide member that guides the cleaning member to move the cleaning member along the surface of the dustproof member, the guide member including a dedicated frontward path through which the cleaning member is inserted to an end of the dustproof member at the back thereof with the cleaning member located at a distance from the surface of the dustproof member, and a dedicated backward path through which the cleaning member is brought into contact with the surface of the dustproof member to perform cleaning when pulling out the cleaning member inserted to the end of the dedicated frontward path at the back thereof; and a movement direction restricting member that is provided at the cleaning member and at least one of the dedicated frontward path and the dedicated backward path, and that restricts a movement direction of the cleaning member so that the cleaning member can be moved only in one direction.

12. The image exposure apparatus cleaning device according to claim 11, wherein the movement direction restricting member is a latch mechanism of wedge shaped protrusion sections having: first faces and second faces on sliding surfaces of the cleaning member and at least one of the dedicated frontward path and the dedicated backward path, wherein the first faces allows a movement of the cleaning member by retreat of at least one of a first surface of the cleaning member and a first surface of the at least one of the dedicated frontward path and the dedicated backward path when the cleaning member is moved in a movable direction, and the second faces of the cleaning member the at least one of the dedicated frontward path and the dedicated backward path mutually inhibit a movement of the cleaning member when the cleaning member is moved in a direction in which the movement thereof is inhibited.

13. The image exposure apparatus cleaning device according to claim 12, wherein the latch mechanism is provided at both of the dedicated frontward path and the dedicated backward path.

14. The image exposure apparatus cleaning device according to claim 13, wherein pitches at which the wedge shaped protrusion sections constituting the latch mechanism are arranged and sizes of the wedge shaped protrusion sections are different between the dedicated frontward path and the dedicated backward path, and a sound generated by the latch mechanism at a time of inserting the cleaning member differs from a sound generated by the latch mechanism at a time of pulling out the cleaning member.

15. An image forming apparatus comprising:

an image forming apparatus main body a photosensitive material attached to the image forming apparatus main body;

an image exposure apparatus having an image exposure window through which light for forming an exposure image on the photosensitive material passes;

a transparent dustproof member provided at the image exposure window;

a cleaning member that cleans a surface of the dustproof member;

a guide member that guides the cleaning member to move the cleaning member along the surface of the dustproof member, the guide member including a dedicated frontward path through which the cleaning member is inserted to an end of the dustproof member at the back thereof with the cleaning member located at a distance from the surface of the dustproof member, and a dedicated backward path through which the cleaning member is brought into contact with the surface of the dustproof member to perform cleaning when pulling out the cleaning member inserted to an end of the dedicated frontward path at the back thereof; and a movement direction restricting member that is provided at the cleaning member and at least one of the dedicated frontward path and the dedicated backward path, and that restricts a movement direction of the cleaning member so that the cleaning member can be moved only in one direction.

* * * * *